US009971268B2

(12) United States Patent
Tanabe et al.

(10) Patent No.: US 9,971,268 B2
(45) Date of Patent: May 15, 2018

(54) CURABLE LIQUID DEVELOPER HAVING A CATIONICALLY POLYMERIZABLE LIQUID MONOMER WITH A MONOFUNCTIONAL VINYL ETHER COMPOUND

(71) Applicant: CANON KABUSHIKI KAISHA, Tokyo (JP)

(72) Inventors: Hiroshi Tanabe, Yokohama (JP); Junji Ito, Hiratsuka (JP); Yasuhiro Aichi, Tokyo (JP); Jun Shirakawa, Kawaguchi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/280,065

(22) Filed: Sep. 29, 2016

(65) Prior Publication Data

US 2017/0090325 A1 Mar. 30, 2017

(30) Foreign Application Priority Data

Sep. 30, 2015 (JP) ..... 2015-195003
Sep. 2, 2016 (JP) ..... 2016-171802

(51) Int. Cl.

| | |
|---|---|
| ***G03G 9/12*** | (2006.01) |
| ***G03G 9/125*** | (2006.01) |
| ***G03G 9/13*** | (2006.01) |
| *G03G 9/135* | (2006.01) |

(52) U.S. Cl.
CPC ..... *G03G 9/125* (2013.01); *G03G 9/131* (2013.01); *G03G 9/135* (2013.01)

(58) Field of Classification Search
CPC ..... G03G 9/135; G03G 9/125
See application file for complete search history.

(56) References Cited

U.S. PATENT DOCUMENTS

| | | | |
|---|---|---|---|
| 5,395,724 A | 3/1995 | Morrison et al. | |
| 2005/0122041 A1 | 6/2005 | Tanabe et al. | |
| 2010/0062361 A1 | 3/2010 | Iwase | |
| 2010/0136474 A1 | 6/2010 | Iwase et al. | |
| 2010/0136475 A1 | 6/2010 | Iwase et al. | |
| 2015/0192875 A1 | 7/2015 | Ito et al. | |
| 2016/0349637 A1 | 12/2016 | Hasegawa et al. | |
| 2016/0349651 A1 | 12/2016 | Ito et al. | |
| 2016/0349652 A1 | 12/2016 | Natori et al. | |
| 2016/0349653 A1 | 12/2016 | Tanabe et al. | |
| 2016/0349654 A1* | 12/2016 | Inoue | G03G 9/131 |
| 2016/0349655 A1 | 12/2016 | Natori et al. | |
| 2016/0349656 A1 | 12/2016 | Hasegawa et al. | |

FOREIGN PATENT DOCUMENTS

| | | |
|---|---|---|
| EP | 0 455 343 | 11/1991 |
| JP | 2003-057883 | 2/2003 |
| JP | 2003-241439 | 8/2003 |
| JP | 3442406 | 9/2003 |
| JP | 2015-127812 | 7/2015 |
| WO | 2006/126566 | 11/2006 |
| WO | 2007/000974 | 1/2007 |
| WO | 2007/000975 | 1/2007 |
| WO | 2007/108485 | 9/2007 |
| WO | 2013/018302 | 2/2013 |

OTHER PUBLICATIONS

Herbst, et al., "Industrial Organic Pigments", 637-645.
Okimoto, et al., "Development of a Highly Efficient Catalytic Method for Synthesis of Vinyl Ethers", Journal of the American Chemical Society, vol. 124, No. 8 (2002) 1590-91.

* cited by examiner

*Primary Examiner* — Christopher D Rodee
(74) *Attorney, Agent, or Firm* — Fitzpatrick Cella Harper and Scinto

(57) ABSTRACT

A curable liquid developer that contains a toner particle, a polymerization initiator, and a cationically polymerizable liquid monomer, wherein the cationically polymerizable liquid monomer contains a compound given by the following formula (A):

$$(R{-}CH{=}CH{-}O{-})_n{-}C_mH_{(2m+2-n)} \qquad \text{formula (A)}$$

[in formula (A), m represents an integer that is at least 12 and not more than 50; n represents an integer that is at least 2; and R represents a hydrogen atom or an alkyl group having at least 1 and not more than 3 carbons].

6 Claims, 7 Drawing Sheets

CURABLE LIQUID DEVELOPER HAVING A CATIONICALLY POLYMERIZABLE LIQUID MONOMER WITH A MONOFUNCTIONAL VINYL ETHER COMPOUND

BACKGROUND OF THE INVENTION

Field of the Invention

The present invention relates to a liquid developer for use in image-forming apparatuses that utilize an electrophotographic system, for example, electrophotography, electrostatic recording, and electrostatic printing.

Description of the Related Art

An electrophotographic system is a method in which printed material is obtained by uniformly charging the surface of an image bearing member such as a photosensitive member (charging step), forming an electrostatic latent image by photoexposure on the surface of the image bearing member (photoexposure step), developing the thereby formed electrostatic latent image with a developer that contains colored resin particles (development step), transferring the developer image to a recording medium such as paper or plastic film (transfer step), and fixing the transferred developer image to the recording medium (fixing step).

The developers here are broadly classified into dry developers and liquid developers: colored resin particles formed of a material that contains a binder resin and a colorant such as a pigment are used in a dry state in the former, while the colored resin particles are dispersed in an electrically insulating liquid in the latter.

The need for color output and high-speed printing from image-forming apparatuses that use an electrophotographic system, e.g., copiers, facsimile machines, printers, and so forth, has been increasing in recent years. Within the realm of color printing, the demand for high-resolution, high-quality images has resulted in demand for developers that can accommodate high-speed printing while having the ability to form high-resolution, high-quality images.

Liquid developers are known to be developers that offer advantages with regard to color image reproducibility. With a liquid developer, the occurrence of aggregation by the colored resin particles in the liquid developer during storage is suppressed, and due to this a microfine toner particle can be used. As a consequence, excellent properties with regard to the reproducibility of fine line images and the reproducibility of gradations are readily obtained with a liquid developer. Development is becoming quite active with regard to high-image-quality, high-speed digital printing apparatuses that utilize electrophotographic technologies that, by exploiting these excellent features, carry out charging of the toner particles in a liquid developer and development and transfer of the developer by electrophoresis. In view of these circumstances, there is demand for the development of liquid developers that have even better properties.

Dispersions of colored resin particles in electrically insulating liquids, e.g., hydrocarbon organic solvents, silicone oils, and so forth, are already known as liquid developers. However, the image quality can be substantially reduced when the electrically insulating liquid remains on the recording medium, e.g., paper, plastic film, and so forth, and it has thus been necessary to remove the electrically insulating liquid. In a method generally used to remove the electrically insulating liquid, thermal energy is applied and the electrically insulating liquid is removed by evaporation. However, this method has not been favorable from an environmental perspective or an energy conservation perspective due to the potential for the emission of organic solvent vapors from the apparatus and due to the large energy requirements.

As a countermeasure here, methods have been proposed in which the electrically insulating liquid is cured by photopolymerization. Photocurable liquid developers use a reactive functional group-bearing monomer as the electrically insulating liquid and further contain a dissolved photopolymerization initiator. This photocurable liquid developer can also accommodate high speeds because it undergoes cure through the reaction of the reactive functional group under exposure to light, e.g., ultraviolet radiation. Such a photocurable liquid developer is proposed in Japanese Patent Application Laid-open No. 2003-57883.

Acrylate monomer, e.g., urethane acrylate, is provided as an example of the reactive functional group-bearing monomer in Japanese Patent Application Laid-open No. 2003-57883.

Japanese Patent No. 3442406 proposes the use as the curable electrically insulating liquid of a curable liquid vehicle having a special range of resistance values. Cationically polymerizable-type curable developers, e.g., epoxy compounds, vinyl ethers, cyclic vinyl ethers, and so forth, are given as examples of the curable liquid vehicle.

In addition, Japanese Patent Application Laid-open No. 2015-127812 provides an example of an ultraviolet-curable liquid developer that avoids a decline in volume resistivity and that exhibits balance between the fixing performance and a high image density; this is achieved through the use of a vinyl ether monomer for the cationically polymerizable liquid monomer and through the combination therewith of a specific polymerization initiator.

SUMMARY OF THE INVENTION

However, the aforementioned acrylate monomer has a low volume resistivity, which facilitates a drop in the potential of the electrostatic latent image in the development step, and as a consequence it has been difficult to obtain a high image density and image blurring (the image presents a deterioration in its sharpness) has been produced.

On the other hand, a humidity-induced inhibition of curing occurs when the aforementioned cationically polymerizable curable liquid developer is used. In order to preserve the fixing performance of the liquid developer even in a humid environment, it is thought to be preferable to mix and use at least a multifunctional monomer having at least 2 vinyl ether groups in each molecule as the cationically polymerizable liquid monomer used in such a liquid developer.

Such a multifunctional vinyl ether monomer is exemplified in Japanese Patent No. 3442406 by 1,4-cyclohexanedimethanol divinyl ether, diethylene glycol divinyl ether, butanediol divinyl ether, hexanediol divinyl ether, octanediol divinyl ether, and decanediol divinyl ether.

Trimethylolpropane trivinyl ether, 2-ethyl-1,3-hexanediol divinyl ether, 2,4-diethyl-1,5-pentanediol divinyl ether, 2-butyl-2-ethyl-1,3-propanediol divinyl ether, neopentyl glycol divinyl ether, pentaerythritol tetravinyl ether, and 1,2-decanediol divinyl ether are also provided as examples in Japanese Patent Application Laid-open No. 2015-127812.

An improvement in the fixing performance in humid environments is seen when these multifunctional vinyl ether monomers are used, but these conventional examples of multifunctional vinyl ether monomers all have low boiling points and are in fact easily volatilized monomers.

After image formation and printing have been completed in an image-forming apparatus that uses a curable liquid developer, the developing roller, intermediate transfer members, and so forth in the apparatus reside in a standby state in which their surfaces are thinly coated by the carrier liquid from the curable liquid developer.

However, in the case of a liquid developer that uses the conventional liquid monomers as described above, the carrier liquid undergoes a gradual volatilization. Diffusion from the apparatus to the outside can be stopped by providing a mechanism that adsorbs the volatilized component, but the installation of an adsorber increases the cost and size of the apparatus.

On the other hand, the apparatus may also be sealed so as to prevent the diffusion of the volatilized carrier component to the outside, but the volatilized carrier component then ends up contaminating other members in the interior of the apparatus. Among these members, the charging device is sensitive to contamination by the volatilized component and upon its contamination the uniformity of charging of the photosensitive member is reduced and a negative effect is exercised on the image quality. The image quality can be recovered to a certain extent by cleaning the members, but a complete cleaning requires manual labor, which is tedious and burdens the running costs.

The present invention provides a liquid developer that solves the problems identified above. Thus, the present invention provides a curable liquid developer that exhibits very little volatilization by the vinyl ether compound used in the curable liquid developer and thus avoids contamination of the members within the apparatus and that, while maintaining a high image quality on a long-term basis, exhibits an excellent fixing performance even in humid environments.

The present invention is a curable liquid developer that contains a toner particle, a polymerization initiator, and a cationically polymerizable liquid monomer, wherein the cationically polymerizable liquid monomer contains a compound given by the following formula (A):

$$(R—CH{=}CH—O—)_n—C_mH_{(2m+2-n)} \qquad \text{formula (A)}$$

[in formula (A), m represents an integer that is at least 12 and not more than 50; n represents an integer that is at least 2; and R represents a hydrogen atom or an alkyl group having at least 1 and not more than 3 carbons].

The present invention can thus provide a curable liquid developer that avoids contamination of the members within the apparatus and that, while maintaining a high image quality on a long-term basis, exhibits an excellent fixing performance even in humid environments.

Further features of the present invention will become apparent from the following description of exemplary embodiments (with reference to the attached drawings).

DESCRIPTION OF THE EMBODIMENTS

Figure 1:
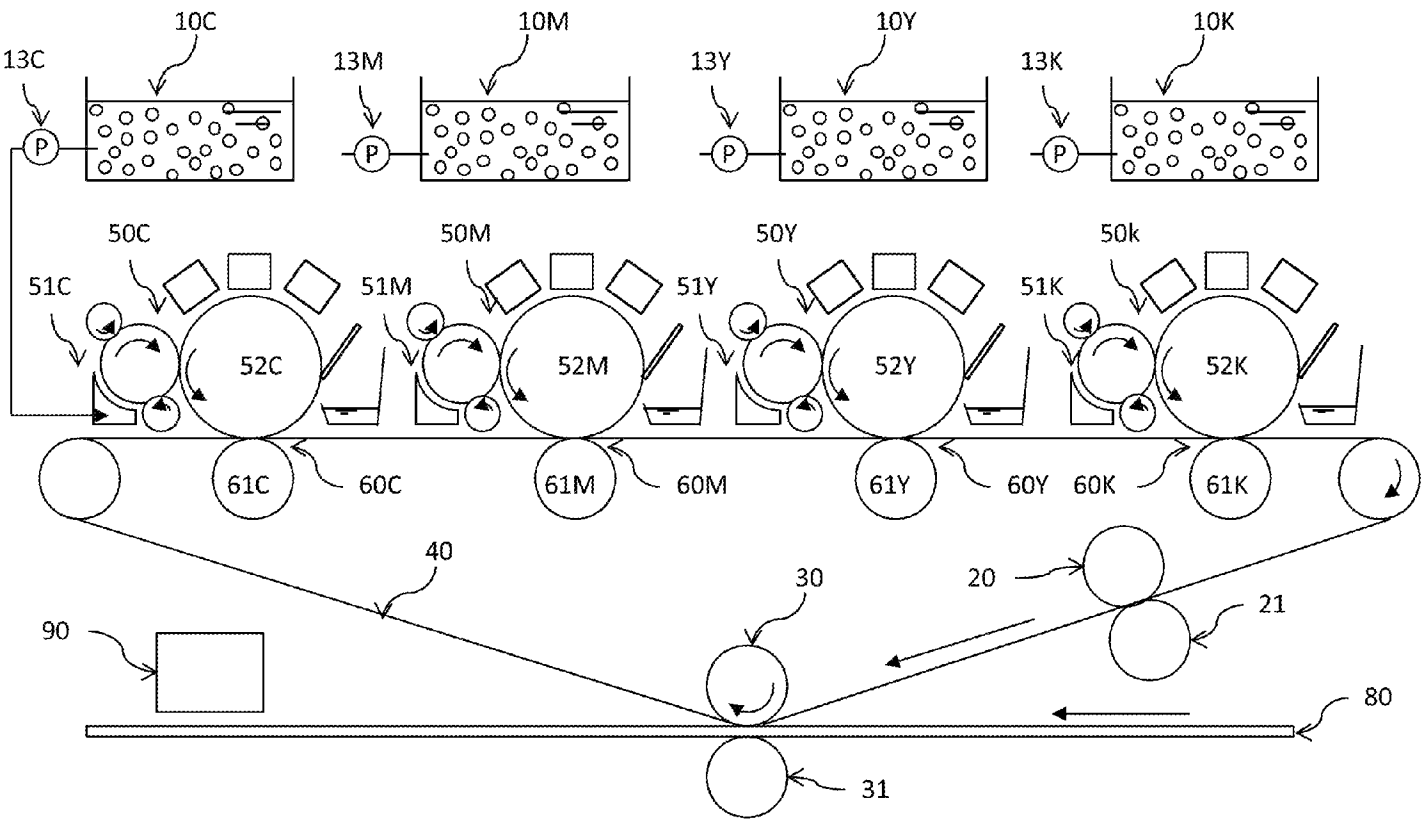
FIG. 1 is a schematic structural diagram of the main section of an image-forming apparatus.

The present invention is described in detail in the following.

The curable liquid developer (also referred to herebelow simply as the liquid developer) of the present invention contains a toner particle, a polymerization initiator, and a cationically polymerizable liquid monomer.

The individual constituent components incorporated in the curable liquid developer of the present invention are described in the following.

[Cationically Polymerizable Liquid Monomer]

The cationically polymerizable liquid monomer in the present invention contains a compound given by the following formula (A):

$$(R—CH{=}CH—O—)_n—C_mH_{(2m+2-n)} \qquad \text{formula (A)}$$

[in formula (A), m represents an integer that is at least 12 and not more than 50 (preferably at least 12 and not more than 25 and more preferably at least 18 and not more than 25); n represents an integer that is at least 2; and R represents a hydrogen atom or an alkyl group having at least 1 and not more than 3 carbons].

The $(R—CH{=}CH—O—)_n$ (indicated in the following as formula (A1)) in formula (A) indicates a vinyl ether group feature, and n indicates the number of vinyl ether groups present in one molecule of the compound.

n in the present invention is an integer of at least 2 and thus indicates a multifunctional monomer that has a plural number of vinyl ether groups. By using a multifunctional monomer, a liquid developer that is less influenced by moisture-induced polymerization inhibitory effect and exhibits an excellent fixing performance in humid environments is thereby obtained.

A cationic polymerization reaction is generally considered to be a polymerization reaction in which a cationic active species is produced by the reaction with the monomer of an acid generated from the polymerization initiator by decomposition induced by exposure to light, wherein the polymerization reaction proceeds successively as long as this cationic active species is present.

It is thought that in the present invention a cationic active species is produced by the reaction of the vinyl ether structure with the acid generated from the polymerization initiator. When water molecules are present at this time in the vicinity of the monomer, this cationic active species is trapped and as a consequence the polymerization does not proceed further.

That is, the chain reaction of one vinyl ether structure is stopped for each one water molecule. Given this, a larger numerical value for n is advantageous for the fixing of the liquid developer.

On the other hand, it is more difficult to acquire the corresponding cationically polymerizable liquid monomer as the numerical value of n increases.

Based on these considerations, n in formula (A1) is preferably at least 2 and not more than 6, is more preferably at least 2 and not more than 4, and is even more preferably at least 2 and not more than 3.

The $—C_mH_{(2m+2-n)}$ (indicated in the following as formula (A2)) in formula (A) is, on the other hand, an alkane chain, and m indicates the number of carbons in the alkane chain. The hydrocarbon may be branched along its course. Evaporation of the monomer can be almost entirely stopped by having the number of carbons in the alkane chain be at least 12, while evaporation of the monomer can be completely stopped when the number of carbons is at least 18.

The viscosity should be a focus when considering the upper limit on the number of carbons in this alkane chain. In order to preserve the electrophoretic speed of the toner particle, the viscosity of the liquid developer at 25° C. is preferably at least 0.5 mPa·s and not more than 100 mPa·s and is more preferably at least 0.5 mPa·s and not more than 30 mPa·s.

When the viscosity is higher than the indicated range, the toner particle electrophoretic speed tends to decline, and the printing speed tends to decline or the print density tends to decline.

The viscosity of the cationically polymerizable liquid monomer in the curable liquid developer of the present invention can be adjusted by having the compound with formula (A) be the major component and adding a viscosity modifier, e.g., a high-viscosity oligomer or a low-viscosity cationically polymerizable liquid monomer other than the compound with formula (A).

Given this, the viscosity of the compound with formula (A) is preferably at least 0.5 mPa·s and not more than 100 mPa·s and is more preferably at least 0.5 mPa·s and not more than 30 mPa·s. This eliminates the necessity for adding a viscosity modifier.

With regard, on the other hand, to the number of carbons in the alkane chain with formula (A2), the viscosity of the monomer itself increases as the number of carbons increases. Considering the preceding, the number of carbons (that is, the value of m) in the alkane chain with formula (A2) is preferably not more than 50 and is more preferably not more than 25.

Specific examples of the compound with formula (A) are given below [example compounds A-1 to A-31], but the present invention is not limited to or by these examples.

(A-1)

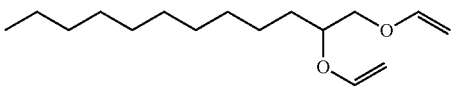

(A-2)

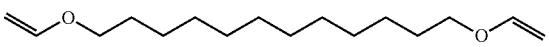

(A-3)

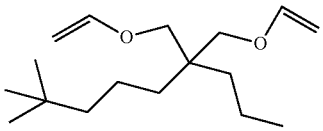

(A-4)

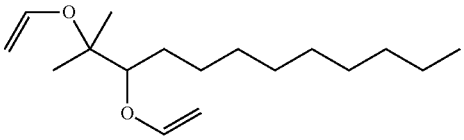

(A-5)

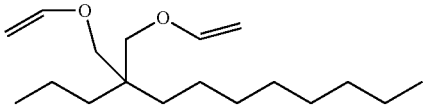

(A-6)

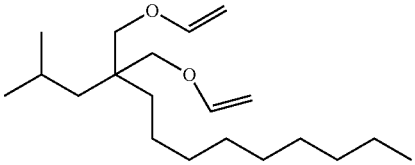

(A-7)

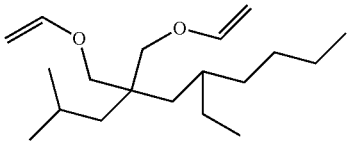

(A-8)

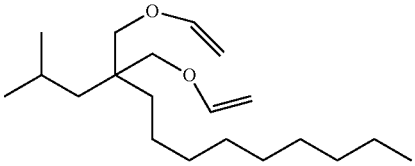

(A-9)

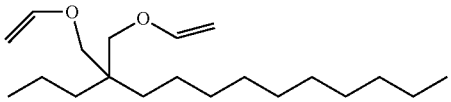

(A-10)

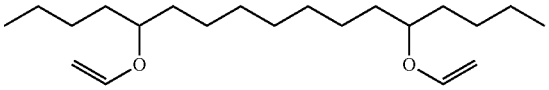

(A-11)

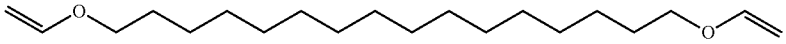

(A-12)

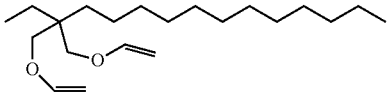

(A-13)

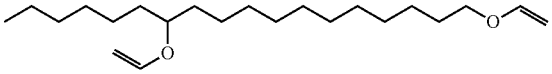

(A-14)

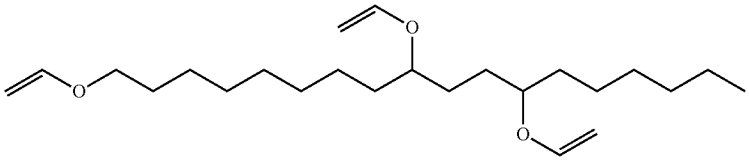

(A-15)

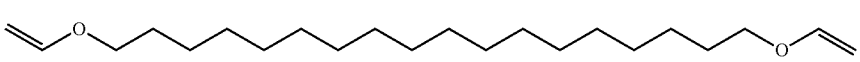

-continued (A-16)

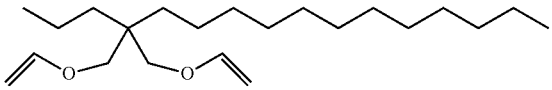

(A-17)

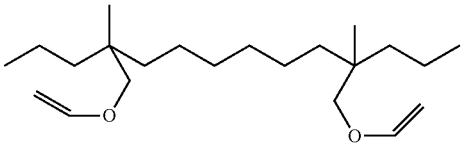

(A-18)

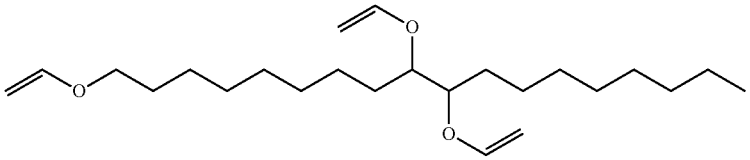

(A-19)

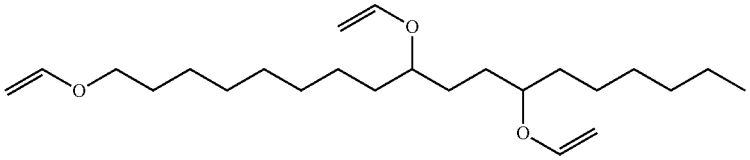

(A-20)

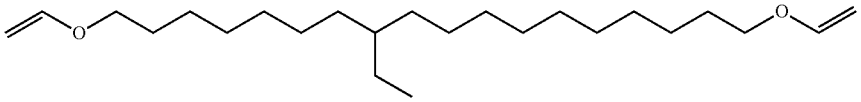

(A-21)

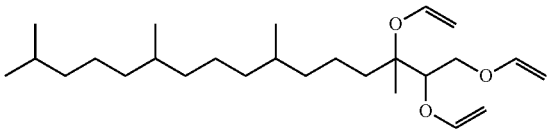

(A-22)

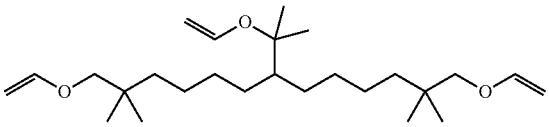

(A-23)

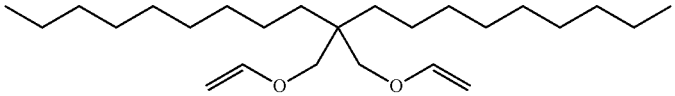

(A-24)

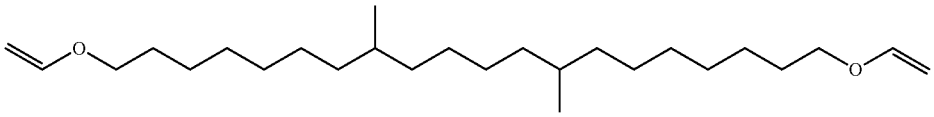

(A-25)

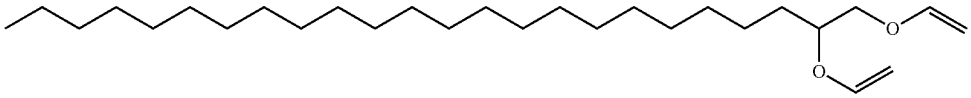

(A-26)

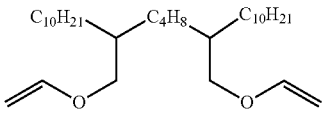

(A-27)

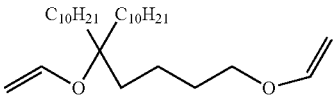

(A-28)

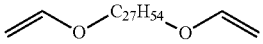

(A-29)

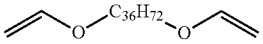

(A-30)

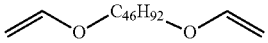

(A-31)

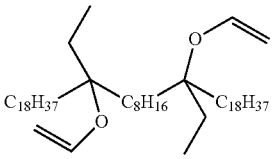

(The $C_xH_y$ moieties in the example compounds denote straight-chain hydrocarbon.)

A single compound with formula (A) can be used or a combination of two or more can be used. In addition, the content of the compound with formula (A) in the cationically polymerizable liquid monomer is preferably at least 60 mass parts and not more than 100 mass parts in 100 mass parts of the cationically polymerizable liquid monomer and is more preferably at least 70 mass parts and not more than 100 mass parts in 100 mass parts of the cationically polymerizable liquid monomer.

The cationically polymerizable liquid monomer is selected in the present invention from liquids that have a high volume resistivity and are electrically insulating and that have a low viscosity at around room temperature.

The cationically polymerizable liquid monomer is also preferably selected from liquids that do not dissolve the binder resin present in the toner particle.

In specific terms, selection is preferably made from cationically polymerizable liquid monomer/binder resin combinations for which not more than 1 mass part of the binder resin dissolves in 100 mass parts of the cationically polymerizable liquid monomer at 25° C.

The volume resistivity of the cationically polymerizable liquid monomer here is preferably about at least $1\times10^{9}$ Ω·cm and not more than $1\times10^{15}$ Ω·cm and is more preferably about at least $1\times10^{10}$ Ω·cm and not more than $1\times10^{15}$ Ω·cm.

When the volume resistivity is less than $1\times10^{9}$ Ω·cm, this facilitates a drop in the potential of the electrostatic latent image and thus makes it increasingly difficult to obtain a high optical density and increasingly facilitates the appearance of image blurring.

On the other hand, the viscosity of the cationically polymerizable liquid monomer at 25° C. is preferably about at least 0.5 mPa·s and less than 100 mPa·s and is more preferably about at least 0.5 mPa·s and less than 30 mPa·s.

The cationically polymerizable liquid monomer in the curable liquid developer of the present invention contains the compound with formula (A). This compound with formula (A) is a vinyl ether compound that does not have a heteroatom outside of the vinyl ether structure (—CH═CH—O—C—).

Here, "heteroatom" denotes an atom other than the carbon atom and hydrogen atom.

When a heteroatom is present in the vinyl ether compound outside of the vinyl ether structure, this not only facilitates the appearance of an intramolecular polarization of the electron density due to the difference between the electronegativity of the heteroatom and that of the carbon atom, but the empty electron orbitals and/or unshared electron pairs possessed by the heteroatom can also become pathways for conduction electrons or holes, and as a consequence a decline in the volume resistivity is facilitated.

In addition, the compound with formula (A) does not have a carbon-carbon double bond outside of the vinyl ether structure in the compound. The carbon-carbon double bond has a high energy level occupied molecular orbital and a low energy level unoccupied molecular orbital, and these readily form a pathway for electrons and holes and then readily lead to a decline in the volume resistivity.

When a carbon-carbon double bond is present in the compound outside of the vinyl ether structure, a reduction in the volume resistivity is facilitated by this mechanism.

The compound with formula (A) is also a structure that does not have a cyclo ring. When a cyclo ring is present, this tends to result in a higher solubility parameter (abbreviated herebelow as the SP value). In the case of a high SP value, the compound itself readily absorbs moisture and as a result in a high-humidity environment an inhibition of the cationic polymerization-mediated cure is facilitated by the water molecules absorbed by the compound and defective fixing of the liquid developer can then occur.

Here, the SP value is a parameter for the affinity: the forces with which two molecules act in a regular solution—i.e., a solution free of actions such as electrostatic interactions, cohesion (hydrogen bonding), dipole interactions, and so forth are hypothesized to be only intermolecular forces, and because of this the solubility parameter is used as a measure that indicates the intermolecular forces. While actual solutions are not limited to regular solutions, it is empirically known that a larger solubility is assumed as the difference between the SP values for two molecules becomes smaller.

The SP values of vinyl ether compounds are generally about 7.0 to 10.0 $(cal/cm^3)^{1/2}$, but in the case of vinyl ether compounds that contain a cyclo ring structure they assume relatively large values of 8.5 to 10.0 $(cal/cm^3)^{1/2}$. The SP value of water, on the other hand, is, at 23.4 $(cal/cm^3)^{1/2}$, a high value even compared with other solvents, and given this the SP value of the vinyl ether compound should be as small as possible in order to prevent the dissolution of moisture.

For example, calculation methods according to Hansen or Hoy, which are estimations from the molecular structure, are methods known for calculating the SP value, but the relatively convenient estimation method according to Fedors is preferably used for this value.

Considering the preceding points, the cationically polymerizable liquid monomer preferably does not have a heteroatom or a carbon-carbon double bond outside the vinyl ether structure and has an alkane chain structure that does not have a cyclo ring.

Viewed in terms of the SP value, because the SP value tends to be lower when a methyl group is present in terminal position on the alkane chain, leaving the methyl group in terminal position on the alkane chain in the present invention provides greater resistance to moisture-induced cure inhibition and is advantageous from the standpoint of the fixing performance.

That is, viewed in terms of the fixing performance, the compound with formula (A) preferably has at least one of vinyl ether groups given by the following formula (A1) in formula (A) bonded to a non-terminal carbon atom of the carbon atoms that form an alkane chain given by the following formula (A2) in formula (A):

$$(R—CH═CH—O—)_n \qquad \text{formula (A1)}$$

$$—C_mH_{(2m+2-n)} \qquad \text{formula (A2)}$$

[in formula (A1) and formula (A2), m represents an integer that is at least 12 and not more than 50 (preferably at least 12 and not more than 25 and more preferably at least 18 and not more than 25); n represents an integer that is at least 2; and R represents a hydrogen atom or an alkyl group having at least 1 and not more than 3 carbons].

The compound with formula (A) may be synthesized by replacing the hydrogen atoms on an alkane with a plurality of hydroxyl groups and then carrying out the vinyl etherification of the hydroxyl groups.

The starting alkane preferably has not more than carbons based on a consideration of the ease of acquisition.

In particular, alkanes having 12 or 18 carbons can be advantageously used because they can be recovered from natural materials, e.g., castor oil.

The hydroxylated alkane may also be acquired commercially: for example, 1,2-dodecanediol (Tokyo Chemical industry Co., Ltd.), 1,12-dodecanediol (Tokyo Chemical Industry Co., Ltd.), 1,12-octadecanediol (product name: HSTOL, KOKURA SYNTHETIC INDUSTRIES, LTD.), and phytantriol (KURARAY CO., LTD.) can be acquired commercially.

Methods for obtaining the vinyl ether group from the hydroxyl group are known: for example, the method using acetylene gas as in WO 2013/018302; the method using vinyl acetate and an iridium complex as disclosed in J. Am. Chem. Soc. 9, Vol. 124, No. 8, 2002, 1590-1591; and the method using palladium and bathophenanthroline.

The cationically polymerizable liquid monomer in the present invention may contain—with the goal, for example, of acting as a viscosity modifier various cationically polymerizable liquid monomers other than the compound with formula (A).

There are no limitations on the cationically polymerizable liquid monomer that can be incorporated as long as the developing performance and fixing performance of the liquid developer are not impaired, and examples are cationically polymerizable liquid monomers such as acrylic monomers, cyclic ether monomers, e.g., epoxides and oxetanes, and vinyl ether compounds other than compounds with formula (A).

Among the preceding, vinyl ether compounds, other than compounds with formula (A), that have a high volume resistivity and a low viscosity and are able to provide a high-sensitivity curable liquid developer, are preferred in the present invention.

Specific examples of vinyl ether compounds [example compounds B-1 to B-22] other than compounds with formula (A) are given below, but the present invention is not limited to or by these examples.

(B-1)

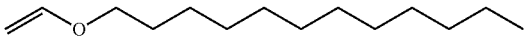

(B-2)

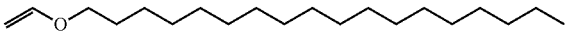

(B-3)

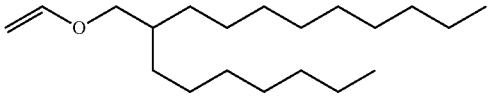

(B-4)

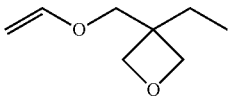

(B-5)

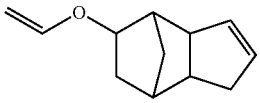

(B-6)

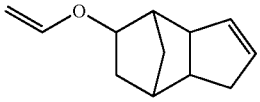

(B-7)

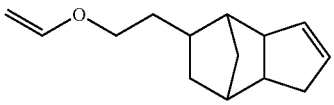

(B-8)

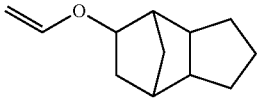

-continued (B-9)

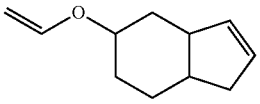

(B-10)

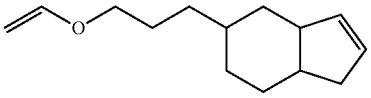

(B-11)

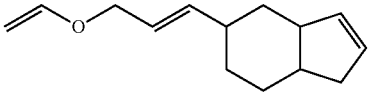

(B-12)

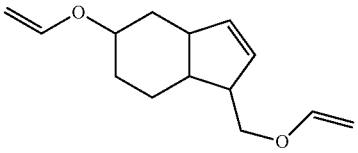

(B-13)

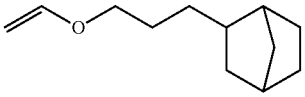

(B-14)

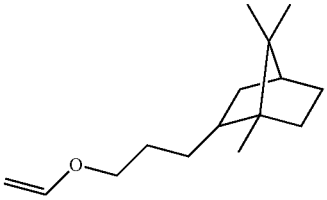

(B-15)

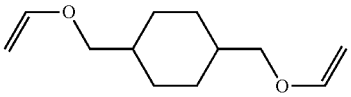

(B-16)

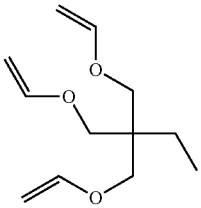

(B-17)

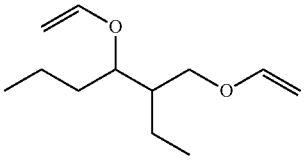

(B-18)

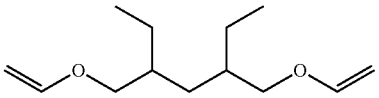

(B-19)

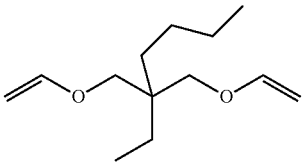

-continued (B-20)

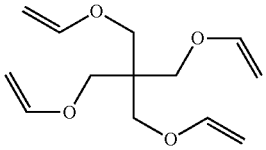

(B-21)

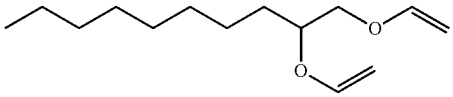

(B-22)

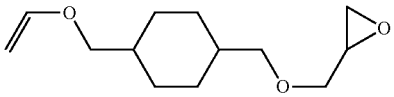

A single one of these vinyl ether compounds can be used or a combination of two or more can be used.

Among the preceding, monofunctional vinyl ether compounds having at least 12 and not more than 50 carbons in the alkane chain segment, for example, dodecyl vinyl ether (B-1), octadecyl vinyl ether (B-2), isostearyl vinyl ether (B-3), and so forth, are preferred based on a consideration of the volatility.

These vinyl ether compounds cause a deterioration in the fixing performance in humid environments because they are all monofunctional monomers that have one vinyl ether group.

However, the fixing performance in humid environments can be preserved through their co-use with a compound with formula (A).

The content of this monofunctional vinyl ether compound is preferably not more than 40 mass parts in 100 mass parts of the cationically polymerizable liquid monomer (i.e., the compound with formula (A) is at least 60 mass parts) and is more preferably not more than 30 mass parts (i.e., the compound with formula (A) is at least 70 mass parts).

Multifunctional monomers that are preferred based on a consideration of the fixing performance, on the other hand, are exemplified by cyclohexanedimethanol divinyl ether (B-15), trimethylolpropane trivinyl ether (B-16), 2-ethyl-1,3-hexanediol divinyl ether (B-17), 2,4-diethyl-1,5-pentanediol divinyl ether (B-18), 2-butyl-2-ethyl-1,3-propanediol divinyl ether (B-19), pentaerythritol tetravinyl ether (B-20), and 2-decanediol divinyl ether (B-21).

These vinyl ether compounds, while they all provide an excellent fixing performance in humid environments, have fewer than 12 carbons in the alkane chain segment. Due to this, when the cationically polymerizable liquid monomer is composed of only these vinyl ether compounds, contamination of the members within the apparatus occurs due to the volatilization of these vinyl ether compounds.

However, contamination of the members within the apparatus can be stopped by co-use with a compound with formula (A).

The content of the multifunctional vinyl ether compound having fewer than 12 carbons in the alkane chain segment is preferably not more than 40 mass parts in 100 mass parts of the cationically polymerizable liquid monomer (i.e., the compound with formula (A) is at least 60 mass parts) and is more preferably not more than 30 mass parts (i.e., the compound with formula (A) is at least 70 mass parts).

The cationically polymerizable liquid monomer may contain an oligomer in the present invention in order to raise the viscosity of the cationically polymerizable liquid monomer.

Vinyl ether oligomers that have the vinyl ether group in terminal position on the oligomer are a preferred feature because they exhibit an excellent curability through polymerization together with the cationically polymerizable liquid monomer.

Specific examples of vinyl ether oligomers [example compounds C-1 to C-6] are provided below, but the present invention is not limited to or by these examples.

(C-1)

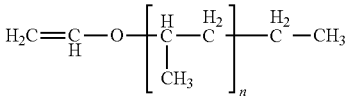

(C-2)

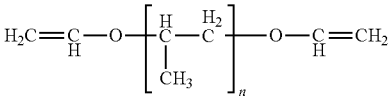

(C-3)

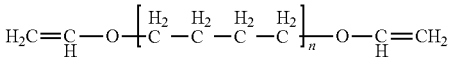

(C-4)

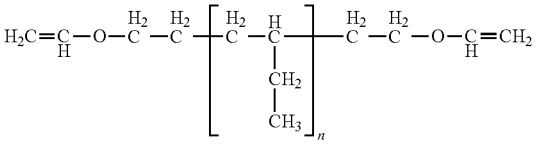

(C-5)

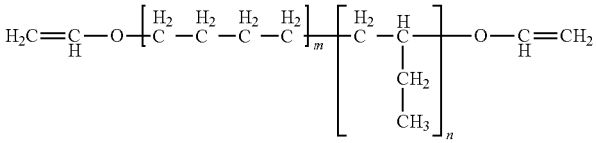

(C-6)

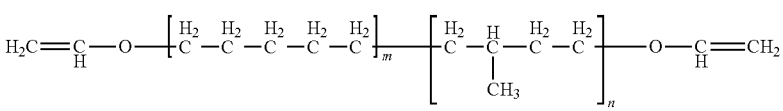

(m and n in the preceding formulas each independently represent integers that provide the example compound with a weight-average molecular weight of at least 1,000 and not more than 10,000.)

These vinyl ether oligomers can be produced by vinyl etherification of the hydroxyl group starting from a hydrogenated polyolefin having the hydroxyl group in terminal position.

Considering the compatibility with the compound with formula (A), the weight-average molecular weight of the vinyl ether oligomer having the vinyl ether group in terminal position is preferably not more than 10,000. In order to realize the function as a thickener, on the other hand, the weight-average molecular weight of the vinyl ether oligomer is preferably at least 1,000.

The content of the vinyl ether oligomer for realizing the function as a thickener, in 100 mass parts of the cationically polymerizable liquid monomer, is preferably about at least 1 mass part and not more than 30 mass parts and is more preferably about at least 5 mass parts and not more than 20 mass parts.

[Polymerization Initiator]

A reaction referred to as an initiation reaction is necessary in order to initiate the polymerization reaction of the cationically polymerizable liquid monomer. The substance used for this purpose is a polymerization initiator.

The following are examples of this polymerization initiator in the present invention.

The cationic polymerization initiator can be exemplified by onium salt compounds and by nonionic compounds such as sulfonyldiazomethane compounds, oxime sulfonate compounds, imidosulfonate compounds, and trichloromethyltriazine compounds; however, there is no limitation to these.

The onium salt compounds can be exemplified by iodonium compounds (for example, IRGACURE (registered trademark) 250 from BASF SE and WPI-113, WPI-116, WPI-169, WPI-170, and WPI-124 from Wako Pure Chemical Industries, Ltd.) and sulfonium compounds (the triarylsulfonium salt compounds CPI-110P and CPI-210S from San-Apro Ltd., and the aromatic sulfonium salt compound Adeka Optomer SP-150 from the ADEKA CORPORATION).

The nonionic compounds can be exemplified by the following compounds.

The sulfonyldiazomethane compounds can be exemplified by WPAG-145 (bis(cyclohexylsulfonyl)diazomethane)), WPAG-170 (bis(t-butylsulfonyl)diazomethane)), and WPAG-199 (bis(p-toluenesulfonyl)diazomethane)) from Wako Pure Chemical industries, Ltd.

The oxime sulfonate compounds can be exemplified by IRGACURE (registered trademark) PAG103 [(5-propylsulfonyloxyimino-5H-thiophen-2-ylidene)-(2-methylphenyl) acetonitrile], IRGACURE (registered trademark) PAG108 [(5-octylsulfonyloxyimino-5H-thiophen-2-ylidene)-(2-methylphenyl)acetonitrile], and IRGACURE (registered trademark) PAG121 [(5-p-toluenesulfonyloxyimino-5H-thiophen-2-ylidene)-(2-methylphenyl)acetonitrile], all from BASF SE.

The imidosulfonate compounds can be exemplified by N-trifluoromethylsulfonyloxysuccinimide and, from Sigma-Aldrich Co. LLC., N-hydroxynaphthalimide triflate and N-hydroxy-5-norbornene-2,3-dicarboximide perfluoro-1-butanesulfonate.

The trichloromethyltriazine compounds can be exemplified by 2-[2-(furan-2-yl)ethenyl]-4,6-bis(trichloromethyl)-s-triazine, 2-[2-(5-methylfuran-2-yl)ethenyl]-4,6-bis(trichloromethyl)-s-triazine, 2-(methoxyphenyl)-4,6-bis(trichloromethyl)-s-triazine, and 2-[2-(3,4-dimethoxyphenyl)ethenyl]-4,6-bis(trichloromethyl)-s-triazine, all from Sanwa Chemical Co., Ltd.

Among these cationic polymerization initiators, the nonionic compounds such as sulfonyldiazomethane compounds, oxime sulfonate compounds, imidosulfonate compounds, and trichloromethyltriazine compounds are preferred. This is because very little reduction in the volume resistivity of the cationically polymerizable liquid monomer occurs when these nonionic compounds are mixed with the cationically polymerizable liquid monomer.

Specific examples and a further description are provided for the imidosulfonate compounds.

The imidosulfonate compounds are exemplified by compounds with the following general formula (1).

general formula (1)

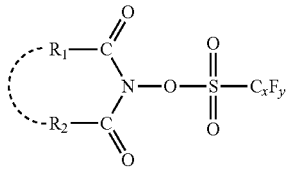

[In general formula (1), $R_1$ and $R_2$ are bonded to each other to form a cyclic structure; x represents an integer that is at least 1 and not more than 8; and y represents an integer that is at least 3 and not more than 17.]

A compound with general formula (1) undergoes photolysis upon exposure to ultraviolet radiation and generates a sulfonic acid, which is a strong acid. In addition, it may be used in combination with a sensitizer, in which case the absorption of ultraviolet radiation by the sensitizer acts as a trigger to cause decomposition of the polymerization initiator and production of the sulfonic acid.

The ring structure formed by the bonding of $R_1$ and $R_2$ can be exemplified by 5-membered rings and 6-membered rings. Specific examples of the ring structure formed by the bonding of $R_1$ and $R_2$ are succinimide structures, phthalimide structures, norbornene dicarboximide structures, naphthalene dicarboximide structures, cyclohexane dicarboximide structures, and epoxycyclohexene dicarboximide structures.

These ring structures may also have, for example, an alkyl group, alkyloxy group, alkylthio group, aryl group, aryloxy group, arylthio group, and so forth as a substituent.

The $C_xF_y$ in general formula (1) can be exemplified by linear-chain alkyl groups in which the hydrogen atom has been substituted by the fluorine atom (RF1), branched-chain alkyl groups in which the hydrogen atom has been substituted by the fluorine atom (RF2), cycloalkyl groups in which the hydrogen atom has been substituted by the fluorine atom (RF3), and aryl groups in which the hydrogen atom has been substituted by the fluorine atom (RF4).

The linear-chain alkyl groups in which the hydrogen atom has been substituted by the fluorine atom (RF1) can be exemplified by the trifluoromethyl group (x=1, y=3), pentafluoroethyl group (x=2, y=5), heptafluoro-n-propyl group (x=3, y=7), nonafluoro-n-butyl group (x=4, y=9), perfluoro-n-hexyl group (x=6, y=13), and perfluoro-n-octyl group (x=8, y=17).

The branched-chain alkyl groups in which the hydrogen atom has been substituted by the fluorine atom (RF2) can be exemplified by the perfluoroisopropyl group (x=3, y=7), perfluoro-tert-butyl group (x=4, y=9), and perfluoro-2-ethylhexyl group (x=8, y=17).

The cycloalkyl groups in which the hydrogen atom has been substituted by the fluorine atom (RF3) can be exemplified by the perfluorocyclobutyl group (x=4, y=7), perfluorocyclopentyl group (x=5, y=9), perfluorocyclohexyl group (x=6, y=11), and perfluoro(1-cyclohexyl)methyl group (x=7, y=13).

The aryl groups in which the hydrogen atom has been substituted by the fluorine atom (RF4) can be exemplified by the pentafluorophenyl group (x=6, y=5) and 3-trifluoromethyltetrafluorophenyl group (x=7, y=7).

For the $C_xF_y$ in general formula (1), the linear-chain alkyl groups (RF1), branched-chain alkyl groups (RF2), and aryl groups (RF4) are preferred from the standpoint of the ease of acquisition and the decomposability of the sulfonate ester moiety. The linear-chain alkyl groups (RF1) and aryl groups (RF4) are more preferred. The trifluoromethyl group (x=1, y=3), pentafluoroethyl group (x=2, y=5), heptafluoro-n-propyl group (x=3, y=7), nonafluoro-n-butyl group (x=4, y=9), and pentafluorophenyl group (x=6, y=5) are particularly preferred.

Specific examples of the compound with general formula (1) [example compounds D-1 to D-27] are given below, but the present invention is not limited to or by these examples.

(D-1)

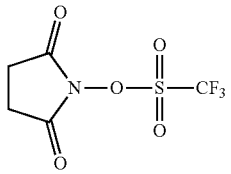

(D-2)

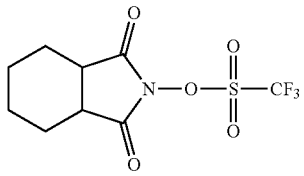

(D-3)

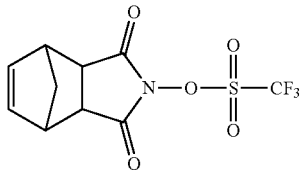

(D-4)

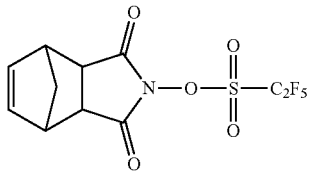

(D-5)

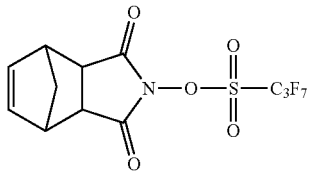

(D-6)

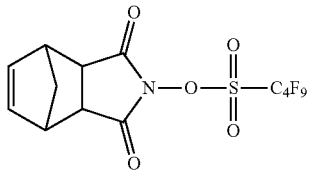

-continued (D-7)

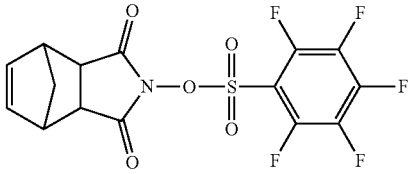

(D-8)

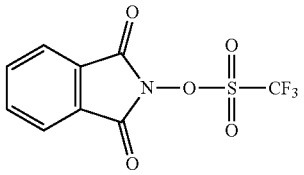

(D-9)

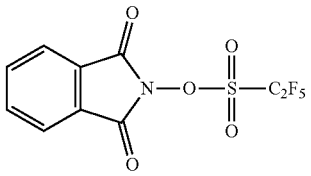

(D-10)

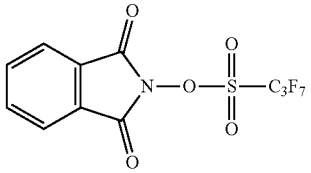

(D-11)

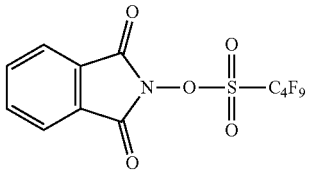

(D-12)

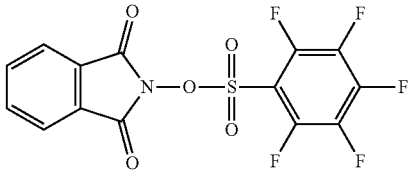

(D-13)

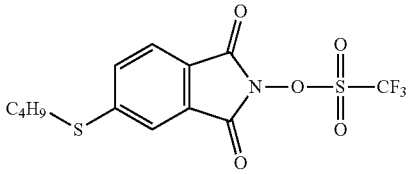

(D-14)

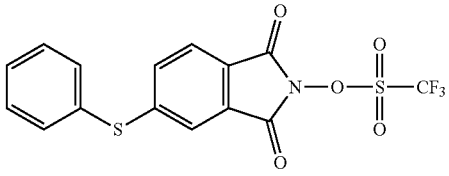

-continued (D-15)

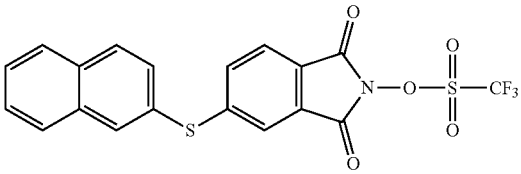

(D-16)

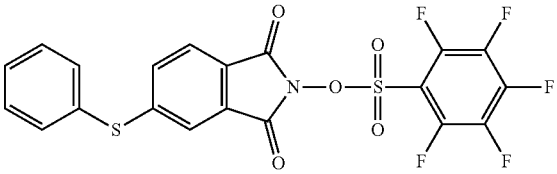

(D-17)

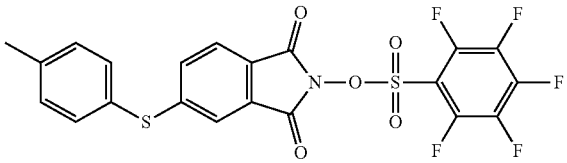

(D-18)

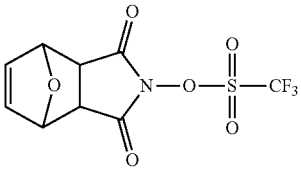

(D-19)

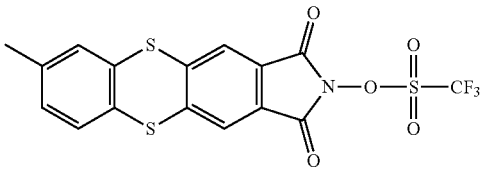

(D-20)

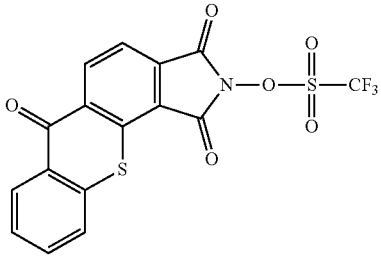

(D-21)

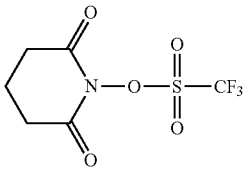

(D-22)

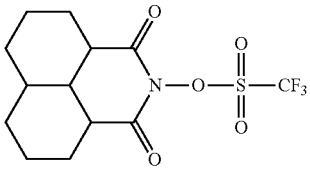

-continued (D-23)

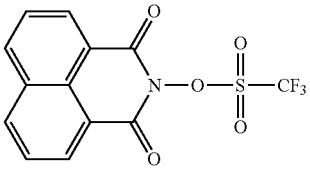

(D-24)

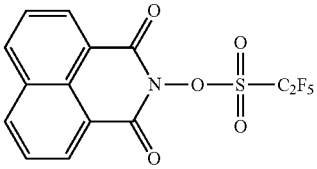

(D-25)

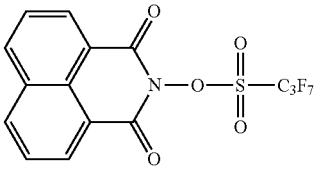

(D-26)

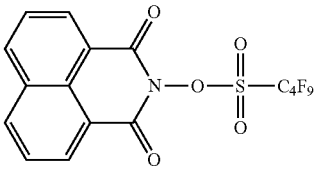

(D-27)

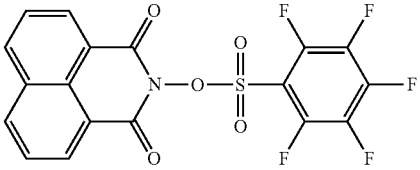

Among the preceding, (D-23), (D-24), (D-25), (D-26), and (D-27) are preferred because in combination with a sensitizer they facilitate obtaining a high fixing performance.

A single polymerization initiator can be used or a combination of two or more can be used.

The content of the polymerization initiator in the curable liquid developer is not particularly limited, but, expressed per 100 mass parts of the cationically polymerizable liquid monomer, is preferably at least 0.01 mass parts and not more than 5 mass parts, more preferably at least 0.05 mass parts and not more than 1 mass part, and even more preferably at least 0.1 mass parts and not more than 0.5 mass parts.

[Toner Particle]

The curable liquid developer of the present invention contains a toner particle.

In addition, the toner particle preferably contains a binder resin and a colorant.

<Binder Resin>

Known binder resins that have a fixing performance for adherends such as paper and plastic film and that are insoluble in the cationically polymerizable liquid monomer can be used as the binder resin incorporated in the toner particle.

Here, insolubility in the cationically polymerizable liquid monomer indicates that not more than 1 mass part of the binder resin dissolves at a temperature of 25° C. in 100 mass parts of the cationically polymerizable liquid monomer.

The binder resin is specifically exemplified by resins such as epoxy resins, ester resins, (meth)acrylic resins, styrene-(meth)acrylic resins, alkyd resins, polyethylene resins, ethylene-(meth)acrylic resins, and rosin-modified resins. As necessary, a single one can be used by itself or two or more can be used in combination.

The binder resin content is not particularly limited, but is preferably at least 50 mass parts and not more than 1,000 mass parts per 100 mass parts of the colorant.

[Colorant]

There are no particular limitations on the colorant incorporated in the toner particle, and, for example, any generally commercially available organic pigment, organic dye, inorganic pigment, or pigment dispersed in, e.g., an insoluble resin as a dispersion medium, or pigment having a resin grafted to its surface can be used.

These pigments can be exemplified by the pigments described in "Industrial Organic Pigments", by W. Herbst and K. Hunger.

With regard to specific examples of these pigments, pigments that present a yellow color can be exemplified by the following:

C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185; and C.I. Vat Yellow 1, 3, and 20.

Pigments that present a red or magenta color can be exemplified by the following:

C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, and 269; C.I. Pigment Violet 19; and C.I. Vat Red 1, 2, 10, 13, 15, 23, 29, and 35.

Pigments that present a blue or cyan color can be exemplified by the following:

C.I. Pigment Blue 2, 3, 15:2, 15:3, 15:4, 16, and 17; C.I. Vat Blue 6; C.I. Acid Blue 45; and copper phthalocyanine pigments in which the phthalocyanine skeleton is substituted by 1 to 5 phthalimidomethyl groups.

Pigments that present a green color can be exemplified by the following:

C.I. Pigment Green 7, 8, and 36.

Pigments that present an orange color can be exemplified by the following:

C.I. Pigment Orange 66 and 51.

Pigments that present a black color can be exemplified by the following:

carbon black, titanium black, and aniline black.

Pigments that present a white color can be exemplified by the following:

basic lead carbonate, zinc oxide, titanium oxide, and strontium titanate.

A dispersing means adapted to the toner particle production method may be used to disperse the pigment in the toner particle. The following are examples of apparatuses that can be used as this dispersing means: ball mill, sand mill, attritor, roll mill, jet mill, homogenizer, paint shaker, kneader, agitator, Henschel mixer, colloid mill, ultrasonic homogenizer, pearl mill, wet jet mill, and so forth.

A pigment dispersing agent may also be added during dispersion of the pigment. The pigment dispersing agent can be exemplified by hydroxyl group-bearing carboxylate esters, the salts of long-chain polyaminoamides and high molecular weight acid esters, the salts of high molecular weight polycarboxylic acids, high molecular weight unsaturated acid esters, high molecular weight copolymers, modified polyacrylates, aliphatic polybasic carboxylic acids, naphthalenesulfonic acid/formalin condensates, polyoxyethylene alkyl phosphate esters, and pigment derivatives. The use of a commercial polymeric dispersing agent, e.g., the Solsperse series from The Lubrizol Corporation, is also preferred.

A synergist adapted to the particular pigment may also be used as a pigment dispersing aid.

These pigment dispersing agents and pigment dispersing aids are preferably added at at least 1 mass part and not more than 50 mass parts per 100 mass parts of the pigment.

[Charge Control Agent]

The curable liquid developer of the present invention may as necessary contain a charge control agent. A known charge control agent can be used.

Examples of specific compounds are as follows:

fats and oils such as linseed oil and soy oil; alkyd resins; halogen polymers; aromatic polycarboxylic acids; acidic group-containing water-soluble dyes; oxidative condensates of aromatic polyamines; metal soaps such as cobalt naphthenate, nickel naphthenate, iron naphthenate, zinc naphthenate, cobalt octylate, nickel octylate, zinc octylate, cobalt dodecanoate, nickel dodecanoate, zinc dodecanoate, aluminum stearate, and cobalt 2-ethylhexanoate; metal sulfonates such as petroleum-based metal sulfonates and metal salts of sulfosuccinate esters; phospholipids such as lecithin and hydrogenated lecithin; metal salicylates such as metal t-butylsalicylate complexes; polyvinylpyrrolidone resins; polyamide resins; sulfonic acid-containing resins; and hydroxybenzoic acid derivatives.

[Charge Adjuvant]

A charge adjuvant can as necessary be incorporated in the toner particle in the present invention with the goal of adjusting the charging behavior of the toner particle. A known charge adjuvant can be used.

Examples of specific compounds are as follows: metal soaps such as zirconium naphthenate, cobalt naphthenate, nickel naphthenate, iron naphthenate, zinc naphthenate, cobalt octylate, nickel octylate, zinc octylate, cobalt dodecanoate, nickel dodecanoate, zinc dodecanoate, aluminum stearate, aluminum tristearate, and cobalt 2-ethylhexanoate; metal sulfonates such as petroleum-based metal sulfonates and the metal salts of sulfosuccinate esters; phospholipids such as lecithin; metal salicylates such as metal t-butylsalicylate complexes; polyvinylpyrrolidone resins; polyamide resins; sulfonic acid-containing resins; and hydroxybenzoic acid derivatives.

[Sensitizer]

As necessary, a sensitizer may be added to the curable liquid developer of the present invention with the goals of, for example, improving the acid-generating efficiency of the polymerization initiator and extending the photosensitive wavelengths to longer wavelengths.

There are no particular limitations on the sensitizer other than that it should be capable of sensitizing the polymerization initiator through an electron transfer mechanism or energy transfer mechanism.

Specific examples are aromatic polycondensed ring compounds such as anthracene, 9,10-dialkoxyanthracene, pyrene, and perylene; aromatic ketone compounds such as acetophenone, benzophenone, thioxanthone, and Michler's ketone; and heterocyclic compounds such as phenothiazine and N-aryloxazolidinone.

The sensitizer content is selected as appropriate in correspondence to the goal, but, per 1 mass part of the polymerization initiator, is generally at least 0.1 mass parts and not more than 10 mass parts and is preferably at least 1 mass part and not more than 5 mass parts.

A sensitizing aid may also be added to the curable liquid developer of the present invention with the goal of improving the electron transfer efficiency or energy transfer efficiency between the aforementioned sensitizer and the polymerization initiator.

Specific examples are naphthalene compounds such as 1,4-dihydroxynaphthalene, 1,4-dimethoxynaphthalene, 1,4-diethoxynaphthalene, 4-methoxy-1-naphthol, and 4-ethoxy-1-naphthol, and benzene compounds such as 1,4-dihydroxybenzene, 1,4-dimethoxybenzene, 1,4-diethoxybenzene, 1-methoxy-4-phenol, and 1-ethoxy-4-phenol.

The sensitizing aid content is selected as appropriate in correspondence to the goal, but, per 1 mass part of the sensitizer, is generally at least 0.1 mass parts and not more than 10 mass parts and preferably at least 0.5 mass parts and not more than 5 mass parts.

[Cationic Polymerization Inhibitor]

A cationic polymerization inhibitor may also be added to the curable liquid developer of the present invention.

The cationic polymerization inhibitor can be exemplified by alkali metal compounds and/or alkaline-earth metal compounds and by amines.

The amines can be exemplified by alkanolamines, N,N-dimethylalkylamines, N,N-dimethylalkenylamines, and N,N-dimethylalkynylamines.

Specific examples are triethanolamine, triisopropanolamine, tributanolamine, N-ethyldiethanolamine, propanolamine, n-butylamine, sec-butylamine, 2-aminoethanol, 2-methylaminoethanol, 3-methylamino-1-propanol, 3-methylamino-1,2-propanediol, 2-ethylaminoethanol, 4-ethylamino-1-butanol, 4-(n-butylamino)-1-butanol, 2-(t-butylamino)ethanol, N,N-dimethylundecanolamine, N,N-dimethyldodecanolamine, N,N-dimethyltridecanolamine, N,N-dimethyltetradecanolamine, N,N-dimethylpentadecanolamine, N,N-dimethylnonadecylamine, N,N-dimethylicosylamine, N,N-dimethyleicosylamine, N,N-dimethylheneicosylamine, N,N-dimethyldocosylamine, N,N-dimethyltricosylamine, N,N-dimethyltetracosylamine, N,N-dimethylpentacosylamine, N,N-dimethylpentanolamine, N,N-dimethylhexanolamine, N,N-dimethylheptanolamine, N,N-dimethyloctanolamine, N,N-dimethylnonanolamine, N,N-dimethyldecanolamine, N,N-dimethylnonylamine, N,N-dimethyldecylamine, N,N-dimethylundecylamine, N,N-dimethyldodecylamine, N,N-dimethyltridecylamine, N,N-dimethyltetradecylamine, N,N-dimethylpentadecylamine, N,N-dimethylhexadecylamine, N,N-dimethylheptadecylamine, and N,N-dimethyloctadecylamine. In addition to these, for example, a quaternary ammonium salt may also be used. The cationic polymerization inhibitor is particularly preferably a secondary amine.

The content of the cationic polymerization inhibitor is preferably at least 1 ppm and not more than 5,000 ppm on a mass basis in the curable liquid developer.

[Radical Polymerization Inhibitor]

A radical polymerization inhibitor may be added to the curable liquid developer of the present invention.

For example, in the case of a curable liquid developer that contains a vinyl ether compound, during storage the polymerization initiator may undergo a trace decomposition and thereby convert into a radical compound and a polymerization caused by this radical compound may then be induced. A radical polymerization inhibitor is desirably added to prevent this.

Usable radical polymerization inhibitors can be exemplified by phenolic hydroxyl group-containing compounds; quinones such as methoquinone (hydroquinone monomet ether), hydroquinone, and 4-methoxy-1-naphthol; hindered amine antioxidants; 1,1-diphenyl-2-picrylhydrazyl free radical; N-oxyl free radical compounds; nitrogen-containing heterocyclic mercapto compounds; thioether antioxidants; hindered phenol antioxidants; ascorbic acids; zinc sulfate; thiocyanates; thiourea derivatives; saccharides; phosphoric acid-type antioxidants; nitrites; sulfites; thiosulfates; hydroxylamine derivatives; aromatic amines; phenylenediamines; imines; sulfonamides; urea derivatives; oximes; polycondensates of dicyandiamide and polyalkylenepolyamine; sulfur-containing compounds such as phenothiazine; complexing agents based on tetraazaannulene (TAA); and hindered amines.

Phenolic hydroxyl group-containing compounds, N-oxyl free radical compounds, 1,1-diphenyl-2-picrylhydrazyl free radical, phenothiazine, quinones, and hindered amines are preferred from the standpoint of preventing the curable liquid developer from undergoing a viscosity increase. N-oxyl free radical compounds are more preferred.

The content of the radical polymerization inhibitor is preferably at least 1 ppm and not more than 5,000 ppm on a mass basis in the curable liquid developer.

[Other Additives]

In addition to those described above, various known additives may as necessary be used in the curable liquid developer of the present invention with the goal of improving the compatibility with recording media, the storage stability, the image storability, and other characteristics. Examples here are surfactant, lubricant, filler, antifoaming agent, ultraviolet absorber, antioxidant, anti-fading agent, fungicide, anticorrosion agent, and so forth, and these can be selected and used as appropriate.

The method of producing the curable liquid developer is not particularly limited in the present invention and can be exemplified by known methods, for example, the coacervation method and the wet pulverization method.

An example of a general production method is a production method in which a pigment, a binder resin and other additives, and a dispersion medium are mixed; pulverization is carried out using, e.g., a bead mill, to obtain a toner particle dispersion; and the obtained toner particle dispersion, a polymerization initiator, the cationically polymerizable liquid monomer, and so forth are mixed to obtain the liquid developer.

The details of the coacervation method are described in, for example, Japanese Patent Application Laid-open No. 2003-241439, WO 2007/000974, and WO 2007/000975.

In the coacervation method, a pigment, resin, solvent that dissolves the resin, and solvent that does not dissolve the resin are mixed and the solvent that dissolves the resin is then removed from the mixture to cause the resin that had been dissolved to precipitate, thereby creating a dispersion of pigment-enclosing toner particles in the solvent that does not dissolve the resin.

The details of the wet pulverization method, on the other hand, are described in, for example, WO 2006/126566 and WO 2007/108485.

In the wet pulverization method, the pigment and binder resin are kneaded at or above the melting point of the binder resin; this is followed by a dry pulverization; and the obtained pulverized material is subjected to a wet pulverization in an electrically insulating medium, thereby creating a dispersion of toner particles in the electrically insulating medium.

Known methods such as these can be used in the present invention.

Viewed from the perspective of obtaining a high-definition image, the volume-average particle diameter of the toner particle is preferably at least 0.05 μm and not more than 5 μm and is more preferably at least 0.05 μm and not more than 1 μm.

The toner particle concentration used in the curable liquid developer in the present invention can be freely adjusted in conformity to the image-forming apparatus used, but is desirably made about at least 1 mass % and not more than 70 mass %.

[Characteristics of the Curable Liquid Developer]

The curable liquid developer of the present invention is preferably used having been prepared so as to have the same property values as ordinary liquid developers.

Viewed from the perspective of avoiding a drop in the potential of the electrostatic latent image, the volume resistivity of the curable liquid developer is preferably at least $1\times10^{10}$ Ω·cm and not more than $1\times10^{13}$ Ω·cm. The present invention makes it possible to prepare a curable liquid developer that satisfies these property values while also exhibiting a high curability.

[Image-Forming Apparatus]

The curable liquid developer of the present invention can be advantageously used in common or ordinary image-forming apparatuses that employ an electrophotographic system.

The application of the curable liquid developer of the present invention to an electrophotographic image-forming apparatus that is a liquid image-forming apparatus (referred to in the following simply as the image-forming apparatus) is described in the following as an exemplary embodiment.

FIG. 1 is a schematic structural diagram of the main section of the image-forming apparatus according to the present embodiment.

The image-forming apparatus is formed of image-forming units 50C, 50M, 50Y, 50K; primary transfer units 60C, 60M, 60Y, 60K; a secondary transfer unit 30; and a developer-curing unit 90.

The image-forming units 50C, 50M, 50Y, 50K respectively function to develop a latent image with a cyan (C) liquid developer, a magenta (M) liquid developer, a yellow (Y) liquid developer, and a black (K) liquid developer.

The image-forming units 50C, 50M, 50Y, 50K are respectively formed of photosensitive members 52C, 52M, 52Y, 52K and liquid developer supply pumps 13C, 13M, 13Y, 13K—which supply developing units 51C, 51M, 51Y, 51K with the respective liquid developer from developer containers 10C, 10M, 10Y, 10K that store the liquid developer, and a charging device, a photoexposure device, a cleaning unit, and a static eliminator are disposed around each of the photosensitive members.

The image-forming units 50C, 50M, 50Y, 50K all have the same structure, and the following description therefore continues with reference to the image-forming unit 50C.

Figure 2:
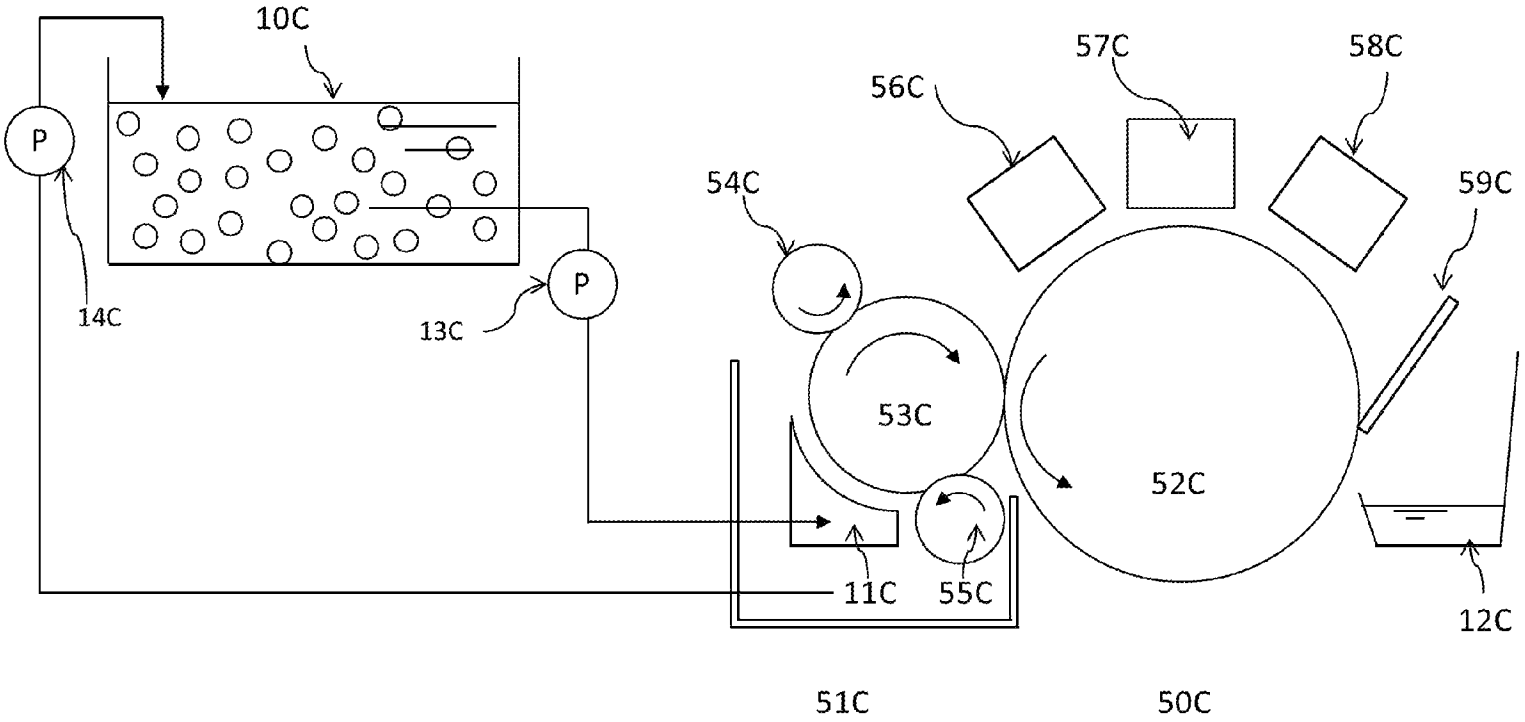
FIG. 2 is a cross-sectional diagram of an image-forming unit.
Figure 3:
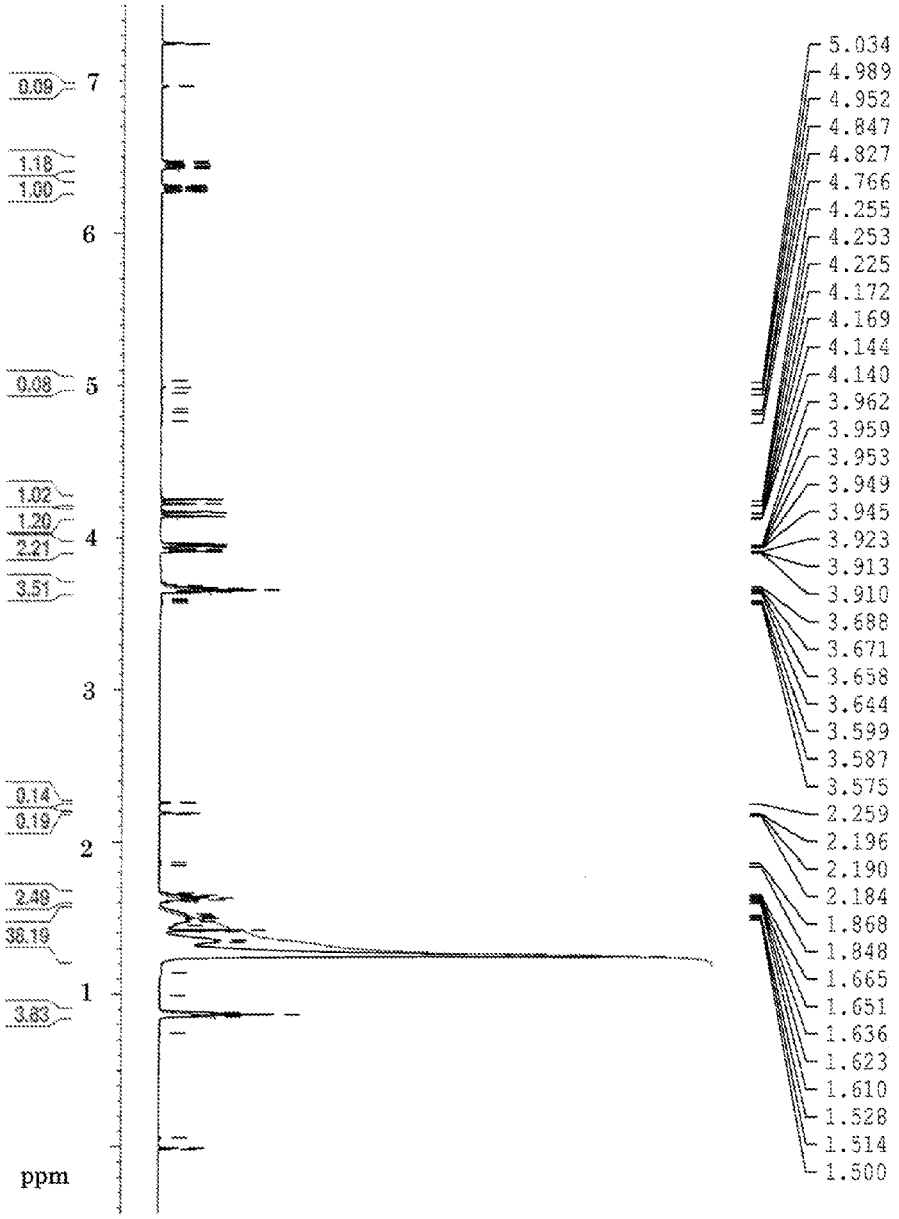
FIG. 3 is the $^1$H-NMR spectral chart of compound A-13.
Figure 4A:
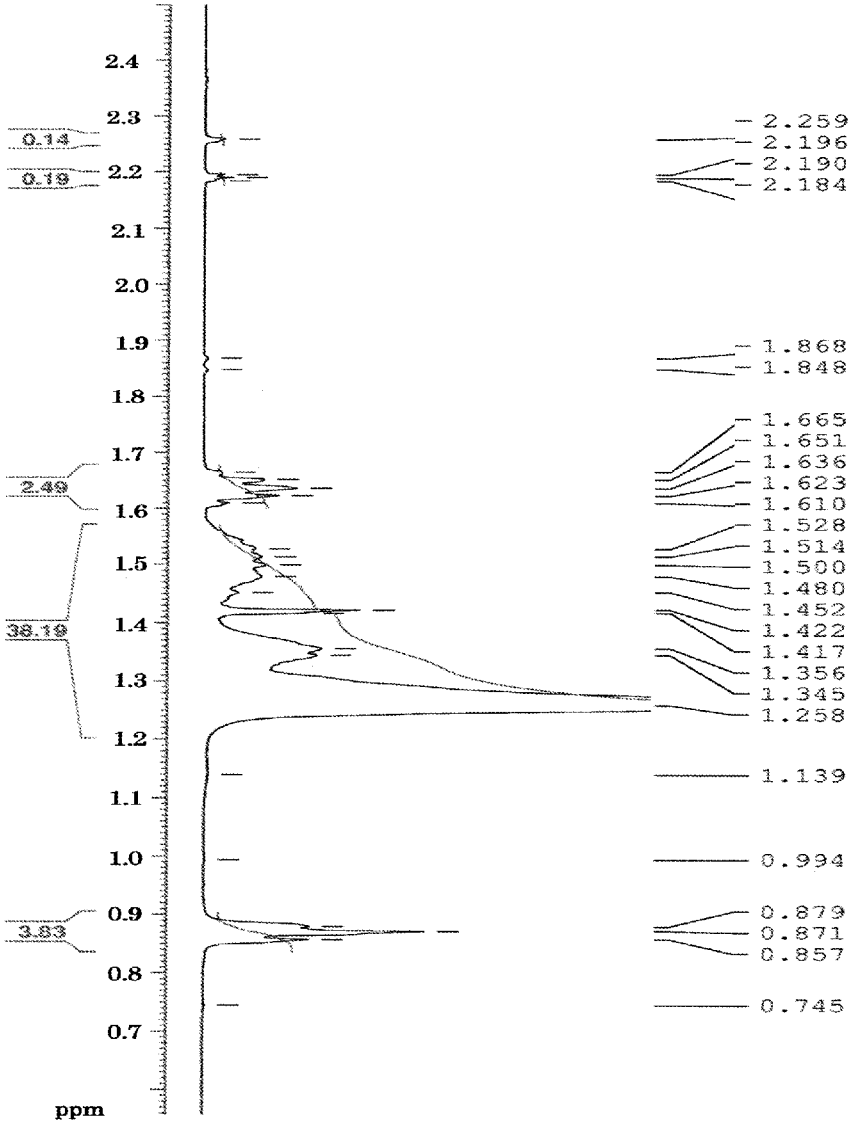
FIG. 4A is an enlargement of FIG. 3.
Figure 4B:
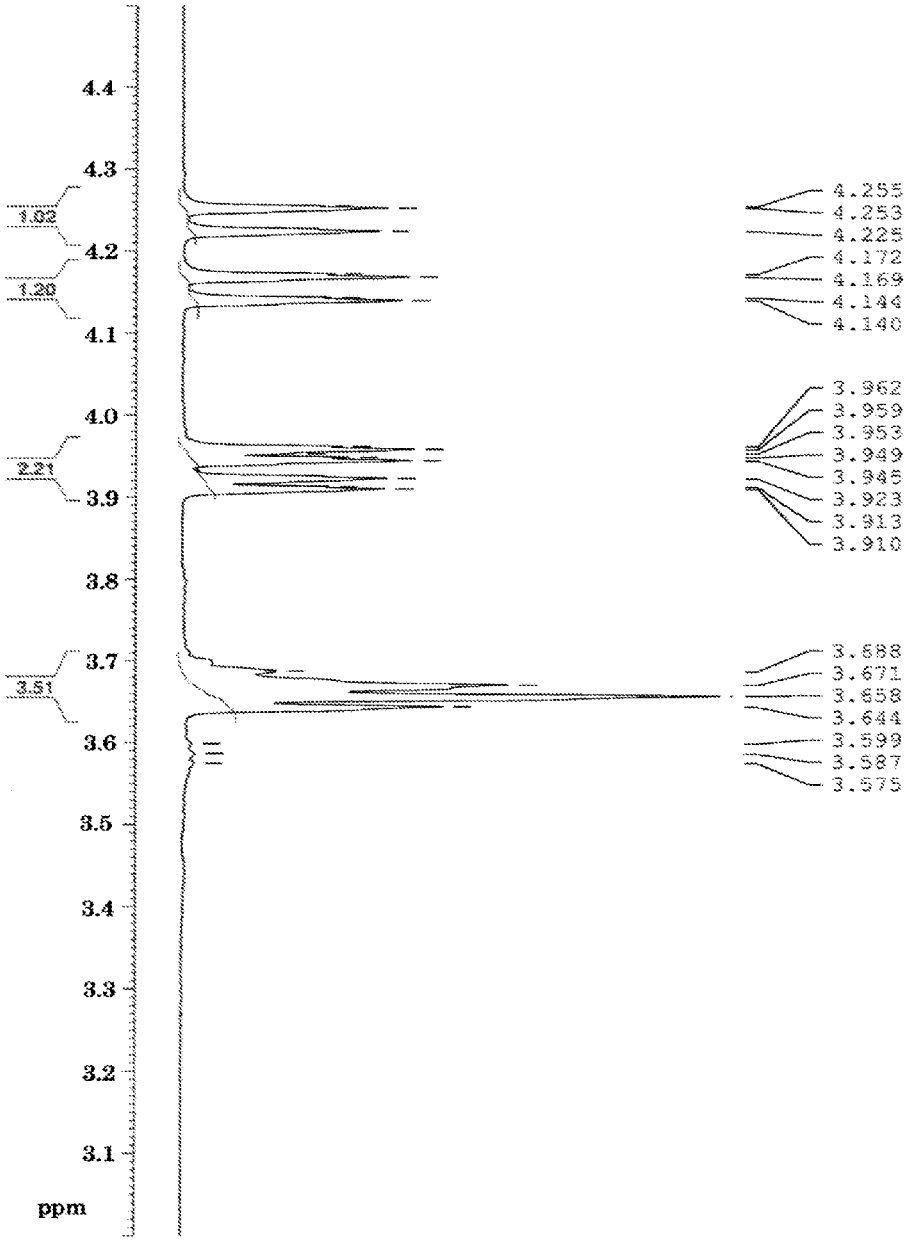
FIG. 4B is an enlargement of FIG. 3.
Figure 4C:
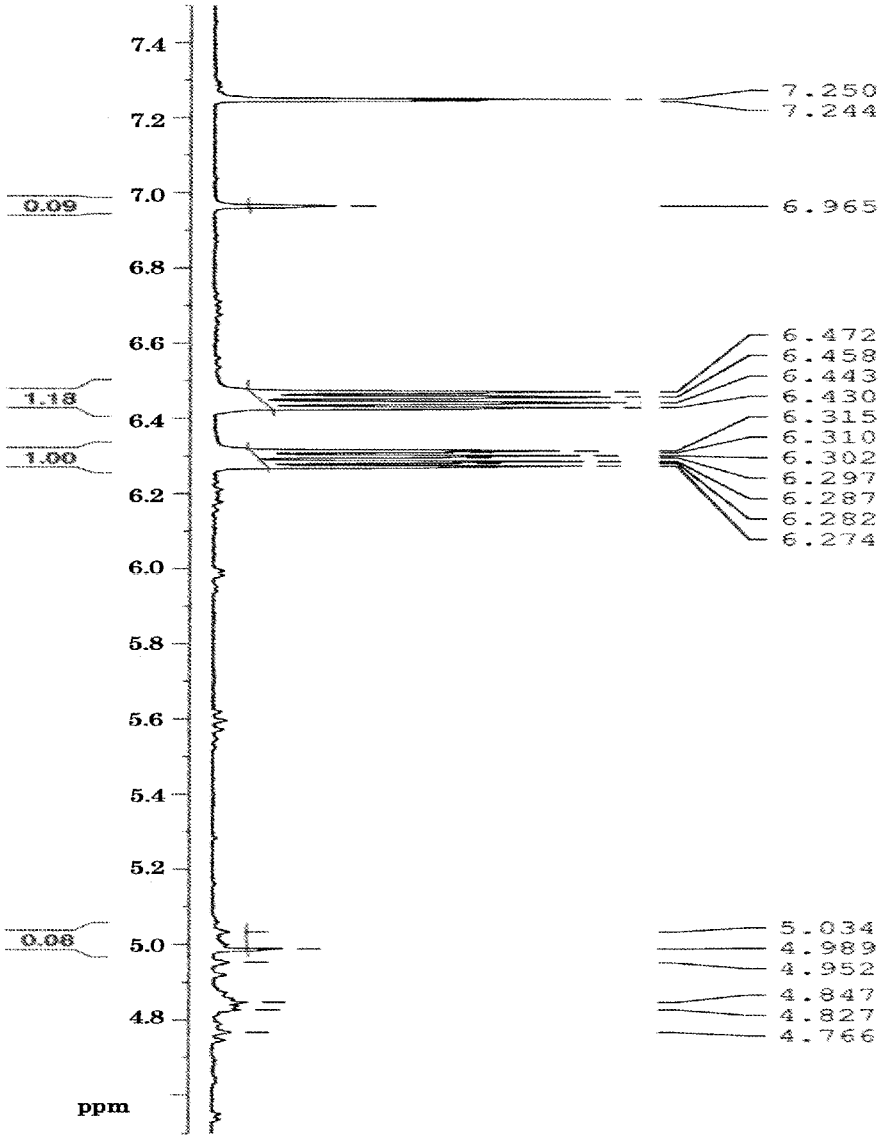
FIG. 4C is an enlargement of FIG. 3.
Figure 5:
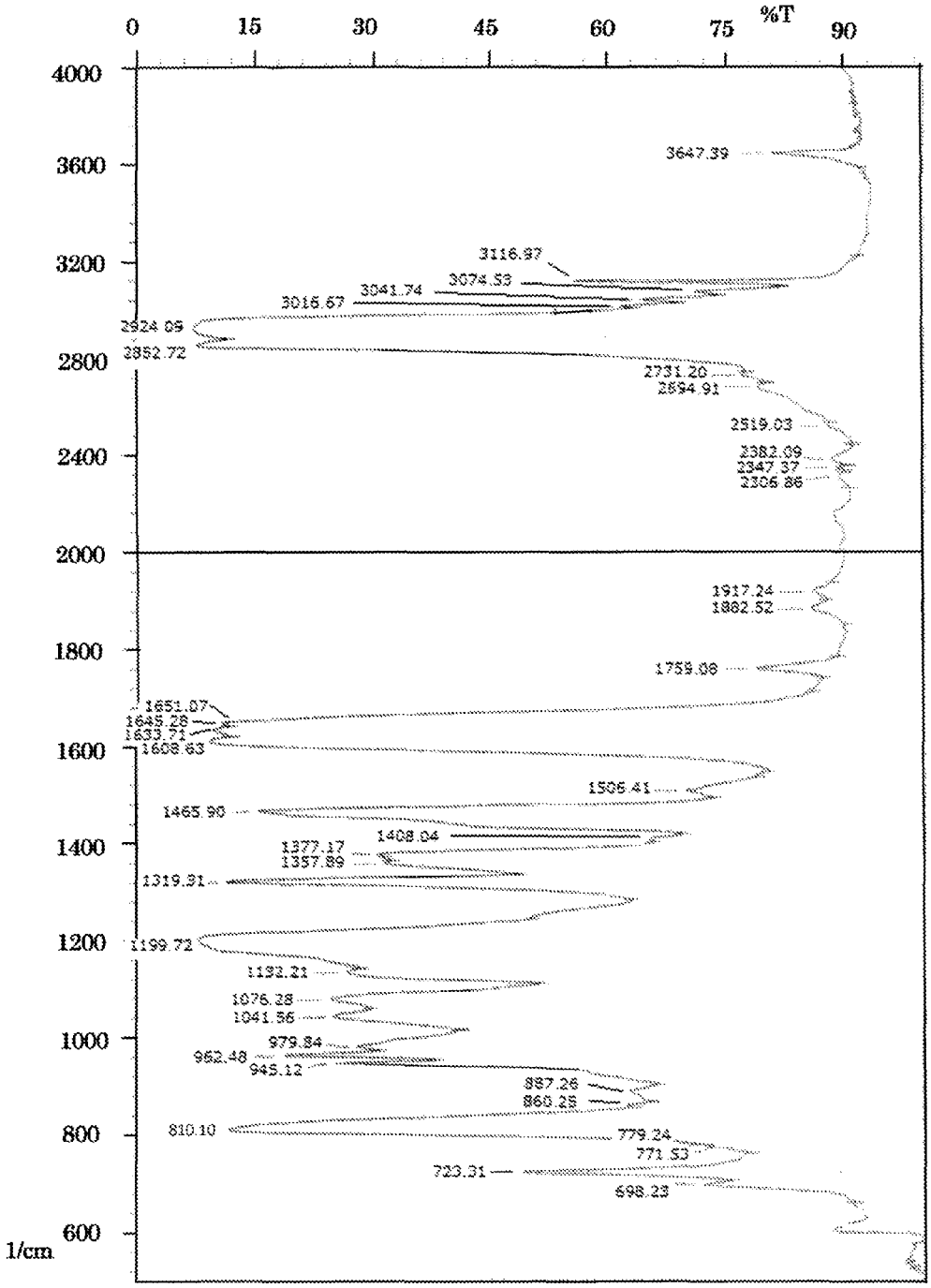
FIG. 5 is an FT-IR spectral chart of compound A-13.

FIG. 2 gives a cross-sectional view of the image-forming unit 50C. A charging unit 57C, a photoexposure unit 56C, a developing unit 51C, a primary transfer unit 60C (FIG. 1), a recovery blade 59C, and a static-eliminating unit 58C are disposed along the direction of rotation of the photosensitive member 52C. The photosensitive member 52C has a cylindrical substrate and a photosensitive layer formed on the outer periphery thereof; is rotatable centered on a central axis; and in the present embodiment undergoes clockwise rotation. The surface of the photosensitive member 52C is formed of amorphous silicon (a-Si). For example, an organic photoconductor (OPC) and so forth can also be used for the material of the photosensitive member.

The charging unit 57C is an apparatus for charging the photosensitive member 52C. A corotron charging device or a roller charging device can be used.

The photoexposure unit 56C has a semiconductor laser, a polygon mirror, an F-θlens, and so forth, and forms a latent image by irradiating a modulated laser onto the charged photosensitive member 52C. A light-emitting diode (LED) or organic light-emitting diode (OLED) can also be disposed as the laser light source.

The static-eliminating unit 58C is a device for neutralizing the photosensitive member 52C. A corona discharge-type charging device or a roller contact-type charging device can be used.

The recovery blade 59C is formed of a rubber part of, e.g., a urethane rubber, which contacts the surface of the photosensitive member 52C, and a plate of, e.g., a metal, which supports the rubber part, and removes the liquid developer remaining on the photosensitive member 52C by scraping it into a recovery unit 12C.

The developing unit 51C is formed of a development roller 53C, a concentration roller 54C, a cleaning roller 55C, and a film-production counterelectrode 11C.

The development roller 53C is a cylindrical member and rotates centered on a central axis in the opposite direction from the photosensitive member 52C as shown in FIG. 2. The development roller 53C is provided with an elastic member, e.g., a conductive urethane rubber, and a resin layer or rubber layer on the outer circumference of an inner core of a metal such as, e.g., iron.

The film-production counterelectrode 11C is disposed with a gap of at least 100 μm with the development roller 53C and is formed of a metal member.

The concentration roller 54C is a cylindrical member and rotates centered on a central axis in the opposite direction from the development roller 53C as shown in FIG. 2. The concentration roller 54C is formed of a metal such as, e.g., iron.

The cleaning roller 55C is a cylindrical member and rotates centered on a central axis in the opposite direction from the development roller 53C as shown in FIG. 2.

The developer container 10C stores a cyan liquid developer for developing the latent image formed on the photosensitive member 52C. The concentration-adjusted liquid developer is fed from the developer container 10C, through a connection conduit in which the liquid developer supply pump 13C is disposed, to the developing unit 51C, while the residual developer is returned to the developer container 10C through a connection conduit in which a developer recovery pump 14C is disposed. The toner particle concentration in the liquid developer in the developer container 10C is adjusted at least to 2 mass %.

The liquid developer having an adjusted toner particle concentration is fed to between the rotating development roller 53C and the film-production counterelectrode 11C, and the liquid developer is coated on the development roller 53C by establishing a bias between the development roller 53C and the film-production counterelectrode 11C. The bias is made at least 100 V, and a bias up to the discharge limit can be established.

The residual fraction of the supplied liquid developer is recovered from a recovery unit 12C through a connection conduit that incorporates a recovery pump and is supplied to a recovery tank (not shown) and is re-used.

The primary transfer units 60C, 60M, 60Y, 60K are respectively formed of an intermediate transfer belt 40, primary transfer rollers 61C, 61M, 61Y, 61K, and the photosensitive members 52C, 52M, 52Y, 52K. The intermediate transfer belt 40 is an endless belt tensioned by a belt driver roller and a driven roller and is driven rotationally while in contact with the photosensitive members 52C, 52M, 52Y, 52K.

A full-color image is formed by the successive transfer of the four liquid developer colors onto the intermediate transfer belt 40 by the primary transfer units 60C, 60M, 60Y, 60K formed of the intermediate transfer belt 40, the primary transfer rollers 61C, 61M, 61Y, 61K, and the photosensitive members 52C, 52M, 52Y, 52K.

The secondary transfer unit 30 is formed of a belt driver roller, a secondary transfer roller 31, a pre-wet roller 20, and a pre-wet counter-roller 21, and transfers, onto a recording medium 80, e.g., paper, a single-color liquid developer image or full-color liquid developer image formed on the intermediate transfer belt 40.

The pre-wet roller 20 is a cylindrical member and rotates centered on a central axis in the opposite direction from the intermediate transfer belt 40 as shown in FIG. 1.

After transporting a carrier liquid from a carrier tank (not shown) to the pre-wet roller 20 and forming a film of the carrier liquid of not more than 1.0 μm on the surface thereof, the amount of the liquid film of the single-color liquid developer image or full-color liquid developer image is adjusted by causing the pre-wet roller 20 to contact the single-color liquid developer image or full-color liquid developer image formed on the intermediate transfer belt 40.

The developer-curing unit 90 irradiates light, e.g., ultraviolet radiation, on the single-color liquid developer image or full-color liquid developer image transferred onto the recording medium 80, causing the reactive functional groups to react and thereby effecting curing. The curing unit is formed of an LED lamp, but there is no limitation to an LED as long as the device can irradiate ultraviolet radiation, and a heating apparatus, an EB-irradiating apparatus, and so forth can also be used.

[Light Source]

The image is fixed by curing the curable liquid developer of the present invention through application of energy thereto immediately after transfer to a recording medium.

The energy source used by the present invention is not particularly limited, but ultraviolet radiation is favorably used. For example, a mercury lamp, metal halide lamp, excimer laser, ultraviolet laser, cold cathode tube, hot cathode tube, black light, or light-emitting diode (LED) is usable as the light source here for carrying out ultraviolet irradiation, and a strip-shaped metal halide lamp, cold cathode tube, hot cathode tube, mercury lamp, black light, or LED is preferred.

The ultraviolet dose is preferably at least 0.1 mJ/cm$^2$ and not more than 1,000 mJ/cm$^2$.

The measurement methods used for the present invention are given below.

<Viscosity Measurement Method>

The viscosity is measured in the present invention using a rotational rheometer technique.

Specifically, the measurement is carried out as follows using a viscoelastic measurement instrument (Physica MCR300, Anton Paar GmbH).

About 2 mL of the sample is filled into the measurement instrument fitted with a cone/plate measurement fixture (75 mm diameter, 1°) and adjustment to 25° C. is carried out. The viscosity is measured while continuously varying the shear rate from 1,000 s$^{-1}$ to 10 s$^{-1}$, and the value at 10 s$^{-1}$ is used as the viscosity.

<Structural Analysis>

Compound structure is determined using a nuclear magnetic resonance instrument ($^1$H-NMR) and the FT-IR spectra.

The instrumentation and measurement methods used in the measurements are as follows.

(i) 1H-NMR measurement instrument: JNM-ECA400 FT-NMR instrument (JEOL Ltd.)
measurement frequency: 500 MHz
pulse condition: 10 μs
frequency range: 10,330 Hz
number of integrations: 16
measurement temperature: 25° C.

50 mg of the sample is introduced into a sample tube having an inner diameter of 5 mm; deuterochloroform ($CDCl_3$) is added as solvent; and the measurement sample is prepared by dissolution at 25° C. Measurement under the conditions indicated above was performed using this measurement sample.

(ii) FT-IR Spectrum measurement instrument: Spectrum One (PerkinElmer Co., Ltd.)
measurement method: single reflection ATR
range start: 4,000 cm$^{-1}$
end: 400 cm$^{-1}$ (KRS-5 ATR crystal)
scan number: 40
resolution: 4.00 cm$^{-1}$
advanced: perform $CO_2$/$H_2O$ correction 0.01 g of the sample is exactly weighed onto the ATR crystal and the sample is pressed using the compression arm. The resulting sample was measured using the conditions indicated above.

EXAMPLES

The curable liquid developer is more specifically described in the following using examples and comparative examples, but the present invention is not limited to or by these.

Unless specifically indicated otherwise, "part(s)" and "%" in the following description denote "mass part(s)" and "mass %", respectively.

Cationically Polymerizable Liquid Monomer Synthesis Example

Synthesis of Example Compound A-13

(reaction equation 1)

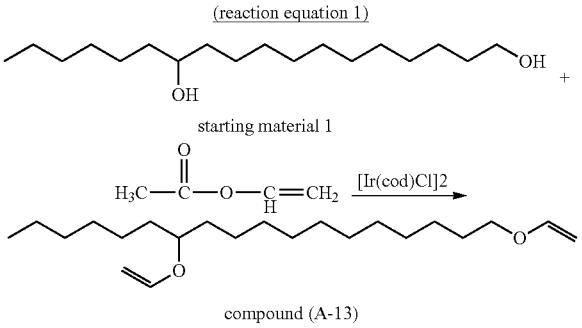

The 1,12-octadecanediol (6.73 g, 24.7 mmol) that is starting material 1 and vinyl acetate (16 g, 186 mmol) were added to a toluene (40.0 mL) mixture of di-μ-chlorobis(1, 5-cyclooctadiene)diiridium(I) $[Ir(cod)Cl]_2$ (0.15 mg, 0.2 mmol) and potassium carbonate (13.5 g, 98 mmol) and this was stirred for 6 hours at 100° C. under an argon atmosphere. Analysis of the reaction solution by gas chromatography showed a 93% conversion of starting material 1 and the production of the difunctional vinyl ether monomer indicated as compound A-13 in a yield of 55%. The organic phase and aqueous phase were separated using a separatory funnel and the organic phase was submitted to column purification, concentration under reduced pressure, and drying to obtain compound A-13 (weight-average molecular weight: 338.6). The obtained compound was a slightly brown, clear viscous liquid. FT-IR measurement of compound A-13 confirmed extinction of the peaks originating with the hydroxyl group.

Example 1

(Toner Particle Production)

25 parts of Nucrel N1525 (ethylene-methacrylic acid resin, DU PONT-MITSUI POLYCHEMICALS CO., LTD.) and 75 parts of dodecyl vinyl ether (example compound B-1) were introduced into a separable flask and, while stirring at 200 rpm using a Three-One motor, the temperature was raised to 130° C. over 1 hour on an oil bath. After holding at 130° C. for 1 hour, slow cooling was carried out at a cooling rate of 15° C. per 1 hour to produce a binder resin dispersion. The obtained binder resin dispersion was a white paste.

59.40 parts of this binder resin dispersion, Pigment Blue 15:3 (4.95 parts) as pigment, 0.20 parts of aluminum tristearate as a charge adjuvant, and 35.45 parts of dodecyl vinyl ether were filled into a planetary bead mill (Classic Line P-6, Fritsch GmbH) along with zirconia beads having a diameter of 0.5 mm, and pulverization was carried out at 200 rpm for 4 hours at room temperature to obtain a toner particle dispersion (solids fraction=20 mass %) that contained 80.00 parts of dodecyl vinyl ether (example compound B-1).

The toner particles present in the obtained toner particle dispersion had a volume-average particle diameter of 0.85 μm [measured with a particle size distribution analyzer based on dynamic light scattering (DLS), product name: Nanotrac 150, NIKKISO CO., LTD.].

(Preparation of Curable Liquid Developer)

10.00 parts of the aforementioned toner particle dispersion, 0.10 parts of hydrogenated lecithin (Lecinol S-10, Nikko Chemicals Co., Ltd.) as a charge control agent, 80.00 parts of compound A-13 synthesized as above as a cationically polymerizable liquid monomer, and additionally 12.00 parts of the example compound B-1 used as a viscosity-modifying monomer in the preparation of the toner particle dispersion were combined, and a curable liquid developer was then obtained by admixing example compound D-26 (0.30 parts) as a polymerization initiator, 0.50 parts of 2,4-diethylthioxanthone as a sensitizer, and 0.50 parts of 1,4-diethoxynaphthalene as a sensitizing aid. The obtained curable liquid developer contained a total of 20.00 parts of the example compound B-1, 8.00 parts from preparation of the toner particle dispersion and 12.00 parts for viscosity modification.

<Evaluations>

The curable liquid developer was evaluated using the following evaluation methods. The results are given in Table 1.

(Image Formation)

Using the image-forming apparatus shown in FIGS. 1 and 2 and the obtained curable liquid developer, an image was formed on a polyethylene terephthalate (PET) sheet and the quality of the obtained image was inspected.

The specific procedure is as follows.

(1) The development roller 53, photosensitive member 52, and primary transfer roller 61 were separated from each other and these were driven in a noncontact condition at different rotations in the directions of the arrows in FIG. 1. The rotation rate at this time was 250 mm/sec.

(2) The development roller 53 and the photosensitive member 52 were brought into contact at a pressing pressure of 5 N/cm and a bias was established using a DC power source. Since the developing bias is desirably in the range from 100 to 400 V, 200 V was used.

(3) The photosensitive member 52 and the primary transfer roller 61 were brought into contact at a prescribed pressing pressure and a bias was established using a DC power source. The transfer bias was made 1,000 V.

(4) The secondary transfer unit 30 and the secondary transfer roller 31 were brought into contact at a prescribed pressing pressure and a bias was established using a DC power source. The transfer bias was made 1,000 V.

(5) The curable liquid developer was supplied to the developer container 10C; using a recording medium provided by adhering a polyethylene terephthalate (PET) sheet (TEIJIN LIMITED, Panlite: PC-2151, thickness=0.3 mm) to a portion of OK Topcoat (Oji Paper Co., Ltd.), a full page-printed solid image was formed on the PET sheet; and evaluation was then carried out.

After the image-forming apparatus had been cleaned and the curable liquid developer had been loaded, image formation was carried out in the initial stage, after 1 day, and after 3 days, and during this interval the interior of the apparatus was not cleaned. The image quality was visually inspected.

(Evaluation Criteria)

5: a high-density, uniform solid image was obtained

4: density non-uniformity and image blurring were not observed and an excellent image was obtained 3: some density non-uniformity or some image blurring was seen, but a generally excellent image was obtained 2: severe density non-uniformity and/or image blurring was produced, locations of unsatisfactory development were observed, and cleaning of the interior of the apparatus was required 1: development almost could not be carried out and cleaning of the interior of the apparatus was required (Fixing Performance)

In a 25° C. room temperature/50% humidity environment, the curable liquid developer was dripped onto a polyethylene terephthalate film (TEIJIN LIMITED, Panlite: PC-2151, thickness=0.3 mm) and was bar-coated (a film with a thickness of 8.0 μm was formed) using a wire bar (No. 6) [supplier: MATSUO SANGYO CO., LTD.], and a cured film was formed by exposure to light at a wavelength of 365 nm using a high-pressure mercury lamp having a lamp output of 120 mW/cm$^2$. The amount of irradiated light was measured for the point at which there was no surface tack (stickiness) and complete curing had occurred; this was evaluated using the following criteria.

5: 100 mJ/cm$^2$

4: 200 mJ/cm$^2$

3: 400 mJ/cm$^2$

2: 1,000 mJ/cm$^2$

1: curing does not occur at 2,000 mJ/cm$^2$

A rank of 3 or higher was regarded as passing in all cases for the image quality in the initial stage, after 1 day, and after 3 days and for the fixing performance. The results of the evaluations are given in Table 1.

Example 2

A toner particle dispersion was produced using compound A-13 in place of the dodecyl vinyl ether (example compound B-1) in the (Toner particle production) of Example 1. In addition, a curable liquid developer was prepared also using compound A-13 in place of example compound B-1 in (Preparation of curable liquid developer). All of the cationically polymerizable liquid monomer was compound A-13 in Example 2.

Examples 3 to 12 and Comparative Examples 1 to 4

Using the toner particle dispersion used in Example 1, curable liquid developers were obtained proceeding as in Example 1, but blending the polymerization initiator and cationically polymerizable liquid monomer so as to obtain the compositions given in Table 1.

In Examples 7 to 12 and the comparative examples, CPI-210S (triarylsulfonium salt polymerization initiator, designated D-28, from San-Apro Ltd.) was used as the polymerization initiator, and 1.00 part was used for its amount of addition.

The same evaluations as in Example 1 were carried out using the thusly obtained curable liquid developers. The results of the evaluations are given in Table 1.

TABLE 1

| | composition of the curable liquid developers | | | | | evaluations | | | |
|---|---|---|---|---|---|---|---|---|---|
| | cationically polymerizable liquid monomer | | | | | | | | |
| | compound with formula (A) | | other monomer or oligomer | | | | | | |
| | type | content (mass parts) | type | content (mass parts) | polymerization initiator | image formation (initial stage) | image formation (after 1 day) | image formation (after 3 days) | fixing performance |
| Example1 | A-13 | 80.00 | B-1 | 20.00 | D-26 | 5 | 5 | 5 | 5 |
| Example2 | A-13 | 100.00 | — | — | D-26 | 5 | 5 | 5 | 5 |
| Example3 | A-13 | 80.00 | B-1 | 8.00 | D-26 | 5 | 5 | 5 | 5 |
| | | | C-4 | 12.00 | | | | | |
| Example4 | A-21 | 80.00 | B-1 | 20.00 | D-26 | 5 | 5 | 5 | 5 |
| Example5 | A-18 | 80.00 | B-1 | 20.00 | D-26 | 5 | 5 | 5 | 5 |
| Example6 | A-13 | 70.00 | B-1 | 30.00 | D-26 | 5 | 5 | 5 | 5 |
| Example7 | A-13 | 70.00 | B-1 | 30.00 | D-28 | 4 | 4 | 4 | 4 |
| Example8 | A-13 | 60.00 | B-1 | 40.00 | D-28 | 4 | 4 | 3 | 4 |
| Example9 | A-1 | 60.00 | B-1 | 40.00 | D-28 | 4 | 3 | 3 | 4 |
| Example10 | A-2 | 60.00 | B-1 | 40.00 | D-28 | 4 | 3 | 3 | 3 |
| Example11 | A-31 | 60.00 | B-1 | 40.00 | D-28 | 3 | 3 | 3 | 4 |
| Example12 | A-30 | 60.00 | B-1 | 40.00 | D-28 | 3 | 3 | 3 | 3 |
| Comparative Example1 | — | — | B-21 | 60.00 | D-28 | 4 | 2 | 2 | 3 |
| | | | B-1 | 40.00 | | | | | |
| Comparative Example2 | — | — | B-15 | 80.00 | D-28 | 4 | 1 | 1 | 4 |
| | | | B-1 | 20.00 | | | | | |
| Comparative Example3 | — | — | B-1 | 100.00 | D-28 | 4 | 3 | 3 | 1 |
| Comparative Example4 | — | — | B-1 | 50.00 | D-28 | 4 | 4 | 4 | 1 |
| | | | B-2 | 50.00 | | | | | |

As is shown by the examples in Table 1, even in a humid environment an excellent image—which was free of density non-uniformity and had an excellent fixing performance—was obtained through the use of a curable liquid developer that used a compound with formula (A) for the major component of the cationically polymerizable liquid monomer. Moreover, there was little decline in image quality of the formed image after 1 day and after 3 days. This means that contamination of the members in the interior of the apparatus had been stopped.

Comparing Example 7 with Example 8, Example 7, which had the larger content of the compound with formula (A) in the cationically polymerizable liquid monomer, had the better image quality after 3 days.

In addition, the number of carbons in the alkane chain of the compound with formula (A) used in Example 8 was 18, in contrast to the number of carbons in the alkane chain in the compounds used in Example 9 and Example 10 being 12, and Example 8 with its larger number of carbons had a smaller decline in image quality after 1 day than in Example 9 and Example 10.

In Example 11 and Example 12, the number of carbons in the alkane chain in the compound with formula (A) used was about 50, and a 3 was assigned in the evaluation of image formation due to a somewhat weak image density in the initial stage.

This is thought to be due to the high viscosity of the curable liquid developer, which caused a decline in the electrophoretic speed of the toner particle and a reduction in the amount of toner particle attaching to the charging roller.

The viscosity of the curable liquid developer in Example 11 and Example 12 was 100 mPa·s, as compared to to 20 mPa·s for the viscosity of the curable liquid developers in the other examples. The upper limit on the number of carbons in the alkane chain in the compound with formula (A) is thus considered to be about 50.

The compounds with formula (A) used in Example 9 and Example 10 have the same number of carbons in the alkane chain and also have the same molecular weight.

The compound with formula (A) used in Example 9 is compound A-1, which had at least one of the vinyl ether groups in formula (A) bonded to a non-terminal carbon atom of the carbon atoms that formed the alkane chain in formula (A).

In contrast to this, the compound with formula (A) used in Example 10 is compound A-2, which had the vinyl ether group at both terminals of the carbon atoms that formed the alkane chain in formula (A).

Example 9, which used a compound that also had the vinyl ether group in the non-terminal position among the carbon atoms forming the alkane chain, had the better fixing performance. This is thought to be due to the SP value of compound A-1 being smaller than the SP value of compound A-2 and the moisture adsorption thus being better inhibited. Calculation of the SP values by Fedors estimation method gave an SP value for compound A-1 of 8.27 and an SP value for compound A-2 of 8.36.

In Comparative Example 1, a difunctional vinyl ether having 10 carbons in the alkane chain (example compound B-21) was used as the major component of the cationically polymerizable liquid monomer. In Comparative Example 2, on the other hand, a difunctional vinyl ether having 8 carbons in the alkane chain (example compound B-15) was used as the major component of the cationically polymerizable liquid monomer. While the fixing performance in Comparative Examples 1 and 2 were not inferior as compared with that in Examples, the image quality of the formed image after 1 day was significantly reduced. Members in the interior of the apparatus were contaminated and were in a state where cleaning was necessary. The image became excellent immediately after the members in the interior of the apparatus were cleaned.

The number of carbons in the alkane chain in the compounds used in Comparative Example 3 and Comparative Example 4 was at least 12, but these were both monofunctional vinyl ether compounds and the fixing performance was thus substantially reduced.

The present invention can thus provide a curable liquid developer that exhibits very little volatilization by the vinyl ether compound used in the curable liquid developer and thus avoids contamination of the members within the apparatus and that, while maintaining a high image quality on a long-term basis, exhibits an excellent fixing performance even in humid environments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-195003, filed Sep. 30, 2015, Japanese Patent Application No. 2016-171802, filed Sep. 2, 2016 which are hereby incorporated by reference herein in their entirety.

What is claimed is:

1. A curable liquid developer comprising a toner particle, a polymerization initiator, and a cationically polymerizable liquid monomer, wherein the cationically polymerizable liquid monomer contains (i) a compound (A) represented by the formula $$(R—CH{=}CH—O—)_n—C_mH_{(2m+2-n)}$$

where m represents an integer from 12 to 50; n represents an integer that is at least 2; and R represents a hydrogen atom or a $C_{1-3}$ alkyl group; and (ii) a monofunctional vinyl ether compound having one vinyl ether group and a $C_{12-50}$ alkane chain segment.

2. The curable liquid developer according to claim 1, wherein at least one of vinyl ether groups given by formula (A1) in compound (A) is bonded to a non-terminal carbon atom of the carbon atoms that form an alkane chain given by formula (A2) in compound (A):

$$(R—CH{=}CH—O—)_n \quad \text{(A1)}$$

$$—C_mH_{(2m+2-n)} \quad \text{(A2).}$$

3. The curable liquid developer according to claim 1, wherein m is an integer from 12 to 25.

4. The curable liquid developer according to claim 1, wherein m is an integer from 18 to 25.

5. The curable liquid developer according to claim 1, wherein the content of compound (A) is 70 to 100 mass parts in 100 mass parts of the cationically polymerizable liquid monomer.

6. The curable liquid developer according to claim 1, wherein the polymerization initiator contains a compound represented by formula (1):

(1)

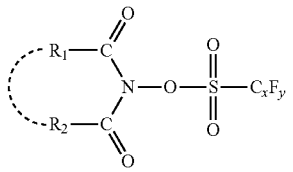

where $R_1$ and $R_2$ each represent a group necessary to form a ring structure by being bonded to each other, the ring structure being selected from the group consisting of a succinimide structure, a phthalimide structure, a norbornene dicarboximide structure, a naphthalene dicarboximide structure, a cyclohexane dicarboximide structure, and an epoxycyclohexene dicarboximide structure; x represents an integer from 1 to 8; and y represents an integer from 3 to 17.

* * * * *